US011202553B2

(12) United States Patent
Sankaran Veerabhagu et al.

(10) Patent No.: US 11,202,553 B2
(45) Date of Patent: Dec. 21, 2021

(54) MULTI-DIRECTIONAL AIR DISTRIBUTION ASSEMBLY FOR A DISHWASHING APPLIANCE

(71) Applicant: Haier US Appliance Solutions, Inc., Wilmington, DE (US)

(72) Inventors: Thiyagarajan Sankaran Veerabhagu, Mount Pleasant, MI (US); Ramasamy Thiyagarajan, Louisville, KY (US); Kyle Edward Durham, Louisville, KY (US); Timothy Kopera, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 245 days.

(21) Appl. No.: 16/142,068

(22) Filed: Sep. 26, 2018

(65) Prior Publication Data

US 2020/0093348 A1 Mar. 26, 2020

(51) Int. Cl.
*A47L 15/48* (2006.01)
*A47L 15/00* (2006.01)

(52) U.S. Cl.
CPC ..... *A47L 15/486* (2013.01); *A47L 15/0013* (2013.01); *A47L 15/488* (2013.01)

(58) Field of Classification Search
CPC ..... A47L 15/0013; A47L 15/0034; A47L 15/486; A47L 15/488; D06F 58/10; F16K 3/184; F16K 3/186
See application file for complete search history.

(56) References Cited

U.S. PATENT DOCUMENTS 2,893,408 A * 7/1959 Walker ..... A47L 15/06 134/57 D
5,273,061 A * 12/1993 Milocco ..... A47L 15/483 134/102.3
2014/0170954 A1* 6/2014 Hintz ..... A47L 15/486 454/251

FOREIGN PATENT DOCUMENTS

DE 102014222541 A1 5/2016
EP 0521815 A1 * 1/1993 ..... A47L 15/488
GB 2274772 A * 8/1994 ..... A47L 15/488
JP H11276415 A 10/1999
KR 100712277 B1 4/2007

OTHER PUBLICATIONS

EP0521815—Machine Translation (Year: 1993).*
DE102014222541—Machine Translation (Year: 2016).*

* cited by examiner

*Primary Examiner* — Marc Lorenzi
(74) *Attorney, Agent, or Firm* — Dority & Manning, P.A.

(57) ABSTRACT

A dishwashing appliance includes a tub defining a wash chamber. An inlet is defined in the tub and provides air flow into the wash chamber. A fan selectively urges air through the inlet in at least two different directions, including a first direction and a second direction. A diverter disk is proximate the inlet downstream of the fan and upstream of the wash chamber. The diverter disk defines an axial direction. The diverter disk is movable along the axial direction between a first position and a second position. The fan urges the diverter disk to move from the second position to the first position when the fan urges air through the inlet in the first direction, and the fan urges the diverter disk to move from the first position to the second position when the fan urges air through the inlet in the second direction.

20 Claims, 20 Drawing Sheets

MULTI-DIRECTIONAL AIR DISTRIBUTION ASSEMBLY FOR A DISHWASHING APPLIANCE

FIELD

The present subject matter relates generally to washing appliances, such as dishwashing appliances and, more particularly, to a venting assembly of a washing appliance.

BACKGROUND

Dishwashing appliances generally include a tub that defines a wash chamber. Rack assemblies can be mounted within the wash chamber for receipt of articles for washing where, e.g., detergent, water, and heat, can be applied to remove food or other materials from dishes and other articles being washed. Various cycles may be included as part of the overall cleaning process. For example, a typical, user-selected cleaning option may include a wash cycle and rinse cycle (referred to collectively as a wet cycle), as well as a drying cycle. In addition, spray-arm assemblies within the wash chamber may be used to apply or direct fluid towards the articles disposed within the rack assemblies in order to clean such articles, e.g., during the wet cycle.

In the drying cycle, air may be introduced into the wash chamber to promote drying of articles therein. However, air introduction assemblies typically provide a fixed direction of air flow which results in incomplete or inconsistent coverage of the articles in the wash chamber with the introduced air.

Accordingly, an improved air flow assembly for a dishwashing appliance which provides improved distribution of incoming air during a drying cycle would be welcomed.

BRIEF DESCRIPTION

Aspects and advantages of the technology will be set forth in part in the following description, or may be obvious from the description, or may be learned through practice of the technology.

In one embodiment a dishwashing appliance is provided. The dishwashing appliance includes a tub defining a wash chamber. An inlet is defined in the tub and provides air flow into the wash chamber. A fan selectively urges air through the inlet in one of a plurality of directions. The plurality of directions includes at least a first direction and a second direction different from the first direction. A diverter disk is proximate the inlet downstream of the fan and upstream of the wash chamber. The diverter disk defines an axial direction. The diverter disk is movable along the axial direction between a first position and a second position. The diverter disk is configured to move from the second position to the first position when the fan urges air through the inlet in the first direction, and to move from the first position to the second position when the fan urges air through the inlet in the second direction.

In another embodiment, a dishwashing appliance is provided. The dishwashing appliance includes a tub defining a wash chamber. An inlet is defined in the tub and provides air flow into the wash chamber. A fan selectively urges air through the inlet in one of a plurality of directions. The plurality of directions includes at least a first direction and a second direction different from the first direction. A diverter disk is proximate the inlet downstream of the fan and upstream of the wash chamber. The diverter disk defines an axial direction. The diverter disk is movable along the axial direction between a first position and a second position.

The fan urges the diverter disk to move from the second position to the first position when the fan urges air through the inlet in the first direction, and the fan urges the diverter disk to move from the first position to the second position when the fan urges air through the inlet in the second direction.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
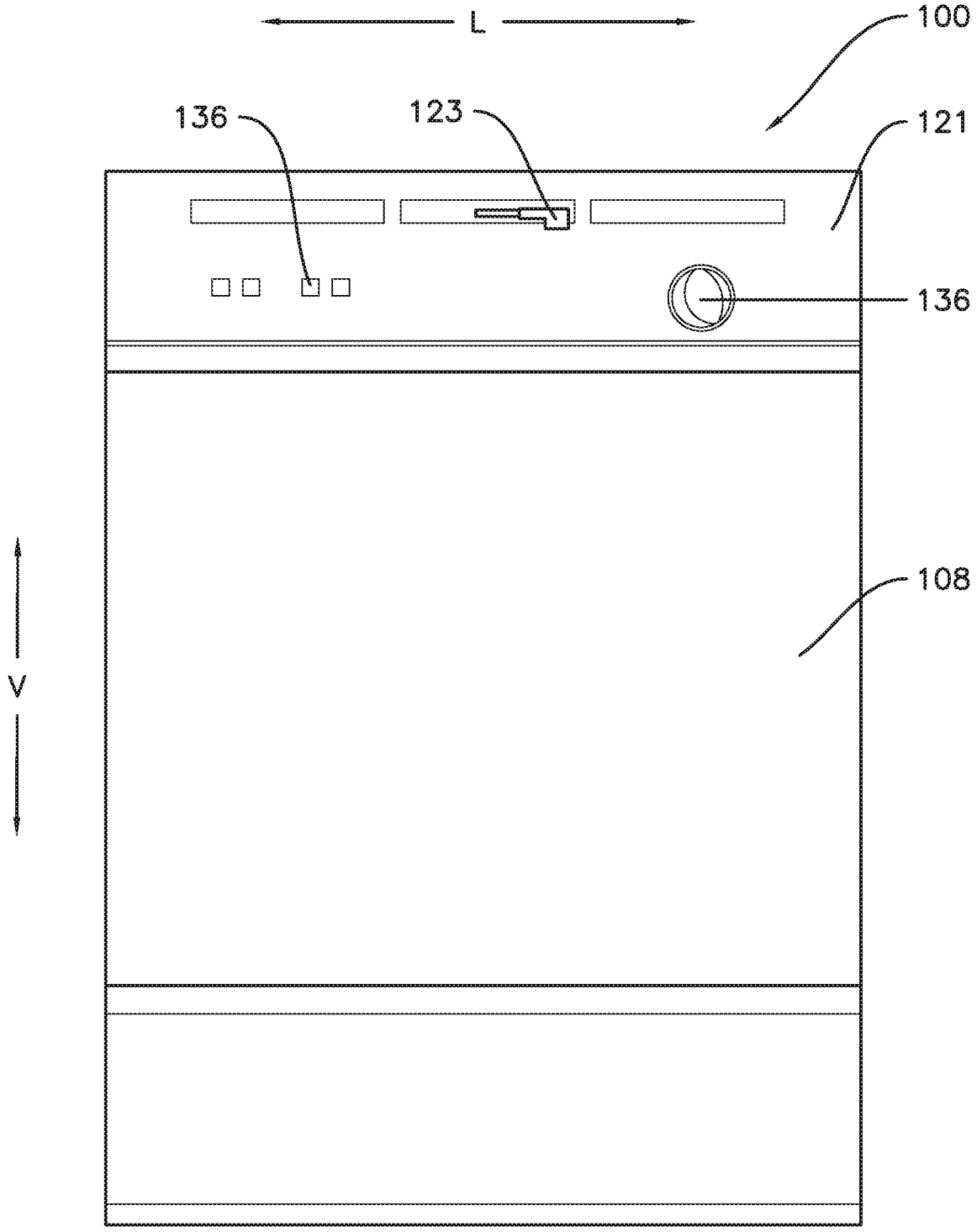
FIG. 1 illustrates a front view of one embodiment of a dishwashing appliance as may incorporate one or more embodiments of the present subject matter.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms "first," "second," and "third" may be used interchangeably to distinguish one component from another and are not intended to signify location or importance of the individual components. The terms "upstream" and "downstream" refer to the relative direction with respect to fluid flow in a fluid pathway. For example, "upstream" refers to the direction from which the fluid flows, and "downstream" refers to the direction to which the fluid flows.

As used herein, terms of approximation such as "generally," "about," or "approximately" include values within ten percent greater or less than the stated value. When used in the context of an angle or direction, such terms include within ten degrees greater or less than the stated angle or direction, e.g., "generally vertical" includes forming an angle of up to ten degrees in any direction, e.g., clockwise or counterclockwise, with the vertical direction V.

Figure 2:
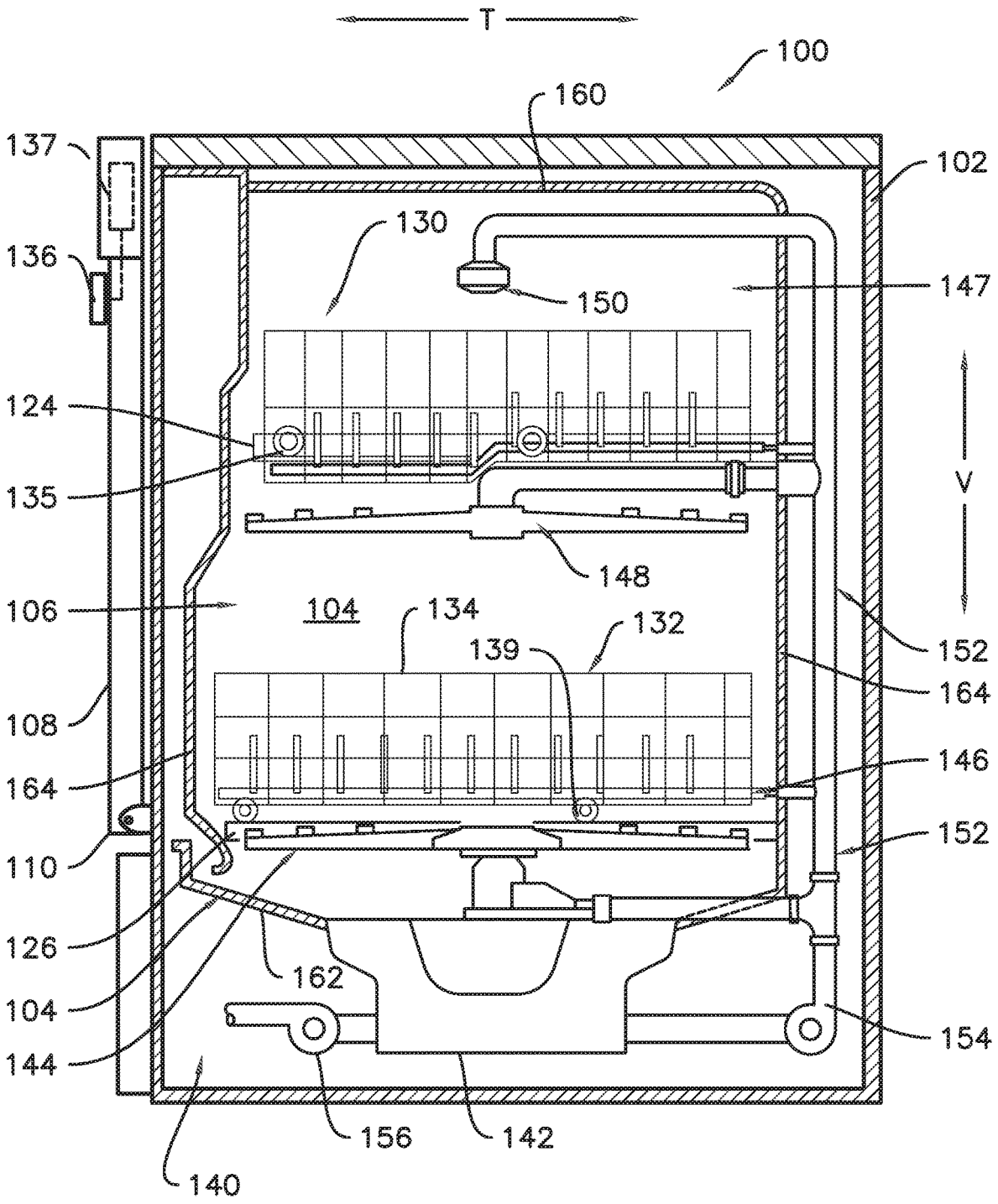
FIG. 2 illustrates a cross-sectional side view of the dishwashing appliance shown in FIG. 1, particularly illustrating various internal components of the dishwashing appliance.

Referring now to the drawings, FIGS. 1 and 2 illustrate one embodiment of a domestic dishwashing appliance 100 that may be configured in accordance with aspects of the present disclosure. As shown in FIGS. 1 and 2, the dishwashing appliance 100 may include a cabinet 102 having a tub 104 therein defining a wash chamber 106. The tub 104 may generally include a front opening (not shown) and a door 108 hinged at its bottom 110 for movement between a normally closed vertical position (shown in FIGS. 1 and 2), wherein the wash chamber 106 is sealed shut for washing operation, and a horizontal open position for loading and unloading of articles from the dishwasher. As shown in FIG. 1, a latch 123 may be used to lock and unlock the door 108 for access to the chamber 106.

As is understood, the tub 104 may generally have a rectangular cross-section defined by various wall panels or walls. For example, as shown in FIG. 2, the tub 104 may include a top wall 160 and a bottom wall 162 spaced apart from one another along a vertical direction V of the dishwashing appliance 100. Additionally, the tub 104 may include a plurality of sidewalls 164 (e.g., four sidewalls) extending between the top and bottom walls 160, 162. It should be appreciated that the tub 104 may generally be formed from any suitable material. However, in several embodiments, the tub 104 may be formed from a ferritic material, such as stainless steel, or a polymeric material.

As particularly shown in FIG. 2, upper and lower guide rails 124, 126 may be mounted on opposing side walls 164 of the tub 104 and may be configured to accommodate roller-equipped rack assemblies 130 and 132. Each of the rack assemblies 130, 132 may be fabricated into lattice structures including a plurality of elongated members 134 (for clarity of illustration, not all elongated members making up assemblies 130 and 132 are shown in FIG. 2). Additionally, each rack 130, 132 may be adapted for movement along a transverse direction T between an extended loading position (not shown) in which the rack is substantially positioned outside the wash chamber 106, and a retracted position (shown in FIGS. 1 and 2) in which the rack is located inside the wash chamber 106. This may be facilitated by rollers 135 and 139, for example, mounted onto racks 130 and 132, respectively. As is generally understood, a silverware basket (not shown) may be removably attached to rack assembly 132 for placement of silverware, utensils, and the like, that are otherwise too small to be accommodated by the racks 130, 132.

Additionally, the dishwashing appliance 100 may also include a lower spray-arm assembly 144 that is configured to be rotatably mounted within a lower region 146 of the wash chamber 106 directly above the bottom wall 162 of the tub 104 so as to rotate in relatively close proximity to the rack assembly 132. As shown in FIG. 2, a mid-level spray-arm assembly 148 may be located above the lower spray-arm assembly 144 within the wash chamber 106, such as by being located in close proximity to the upper rack 130. Moreover, an upper spray assembly 150 may be located above the upper rack 130.

As is generally understood, the lower and mid-level spray-arm assemblies 144, 148 and the upper spray assembly 150 may generally form part of a fluid circulation system 152 for circulating fluid (e.g., water and dishwasher fluid which may also include water, detergent, and/or other additives, and may be referred to as wash liquor) within the tub 104. As shown in FIG. 2, the fluid circulation system 152 may also include a recirculation pump 154 located in a machinery compartment 140 below the bottom wall 162 of the tub 104, as is generally recognized in the art, and one or more fluid conduits for circulating the fluid delivered from the pump 154 to and/or throughout the wash chamber 106. The tub 104 may include a sump 142 positioned at a bottom of the wash chamber 106 for receiving fluid from the wash chamber 106. The recirculation pump 154 receives fluid from sump 142 to provide a flow to fluid circulation system 152, which may include a switching valve or diverter (not shown) to select flow to one or more of the lower and mid-level spray-arm assemblies 144, 148 and the upper spray assembly 150.

Moreover, each spray-arm assembly 144, 148 may include an arrangement of discharge ports or orifices for directing washing liquid onto dishes or other articles located in rack assemblies 130 and 132, which may provide a rotational force by virtue of washing fluid flowing through the discharge ports. The resultant rotation of the lower spray-arm assembly 144 provides coverage of dishes and other dishwasher contents with a washing spray.

A drain pump 156 may also be provided in the machinery compartment 140 and in fluid communication with the sump 142. The drain pump 156 may be in fluid communication with an external drain (not shown) to discharge fluid, e.g., used wash liquid, from the sump 142.

The dishwashing appliance 100 may be further equipped with a controller 137 configured to regulate operation of the dishwasher 100. The controller 137 may generally include one or more memory devices and one or more microprocessors, such as one or more general or special purpose microprocessors operable to execute programming instructions or micro-control code associated with a cleaning cycle. The memory may represent random access memory such as DRAM, or read only memory such as ROM or FLASH. In one embodiment, the processor executes programming instructions stored in memory. The memory may be a separate component from the processor or may be included onboard within the processor.

The controller 137 may be positioned in a variety of locations throughout dishwashing appliance 100. In the illustrated embodiment, the controller 137 is located within a control panel area 121 of the door 108, as shown in FIG. 1. In such an embodiment, input/output ("I/O") signals may be routed between the control system and various operational components of the dishwashing appliance 100 along wiring harnesses that may be routed through the bottom of the door 108. Typically, the controller 137 includes a user interface panel/controls 136 through which a user may select various operational features and modes and monitor progress of the dishwasher 100. In one embodiment, the user interface 136 may represent a general purpose I/O ("GPIO") device or functional block. Additionally, the user interface 136 may include input components, such as one or more of a variety of electrical, mechanical or electro-mechanical input devices including rotary dials, push buttons, and touch pads. The user interface 136 may also include a display component, such as a digital or analog display device designed to provide operational feedback to a user. As is generally understood, the user interface 136 may be in communication with the controller 137 via one or more signal lines or shared communication busses. It should be noted that controllers 137 as disclosed herein are capable of and may be operable to perform any methods and associated method steps as disclosed herein.

It should be appreciated that the present subject matter is not limited to any particular style, model, or configuration of dishwashing appliance. The exemplary embodiment depicted in FIGS. 1 and 2 is simply provided for illustrative purposes only. For example, different locations may be provided for the user interface 136, different configurations may be provided for the racks 130, 132, and other differences may be applied as well.

Figure 3:
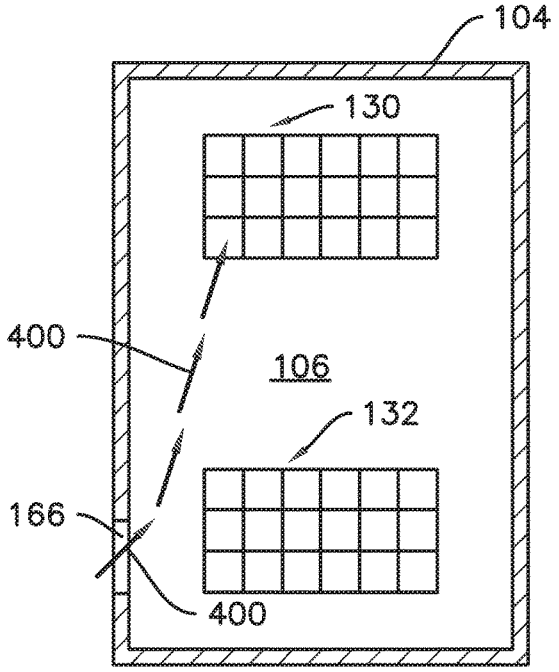
FIG. 3 provides a schematic view of a dishwashing appliance including an air distribution system in a first position according to one or more embodiments of the present subject matter.
Figure 4:
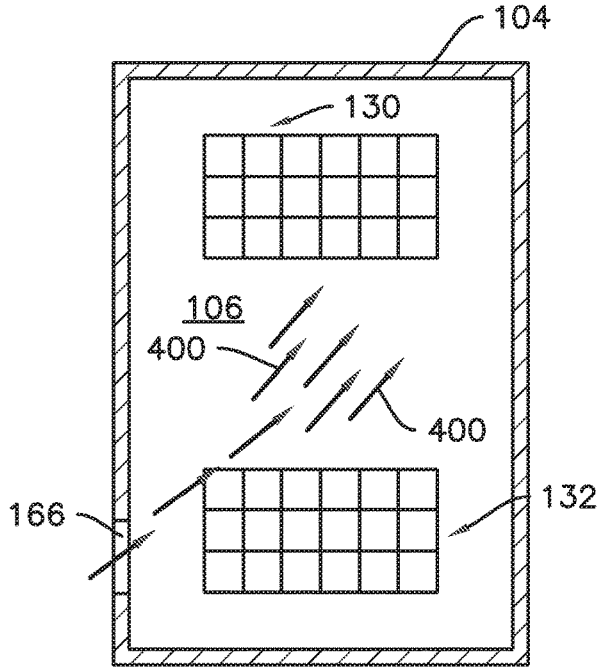
FIG. 4 provides a schematic view of the dishwashing appliance of FIG. 3 with the air distribution system in a second position.
Figure 5:
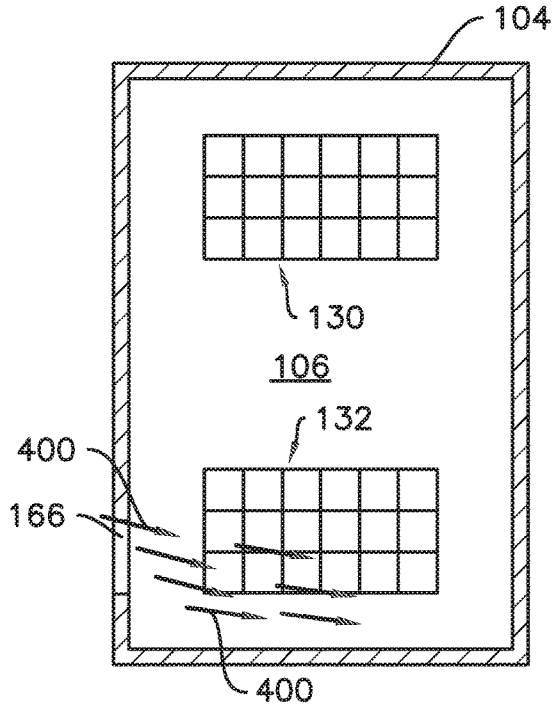
FIG. 5 provides a schematic view of the dishwashing appliance of FIG. 3 with the air distribution system in a third position.
Figure 6:
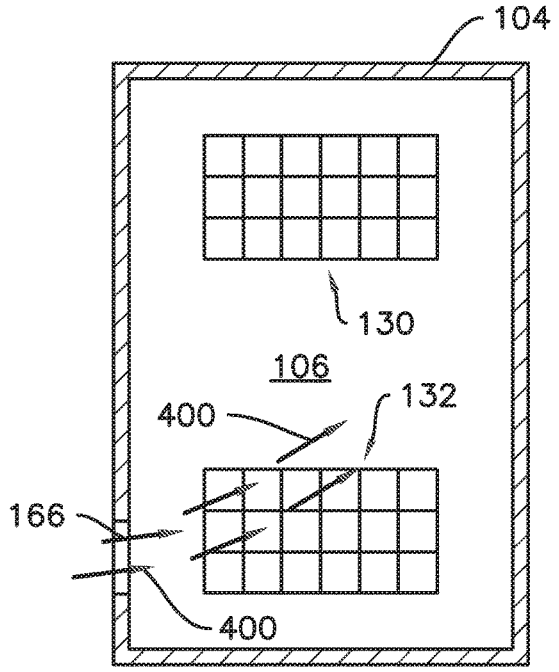
FIG. 6 provides a schematic view of the dishwashing appliance of FIG. 3 with the air distribution system in a fourth position.

Turning now to FIGS. 3 through 6, a flow of air 400 may be provided in order to promote drying of the wash chamber 106 and/or of wet articles therein. The flow of air 400 may travel through the wash chamber 106 to promote drying of dishes or other articles located in rack assemblies 130 and 132 within the wash chamber 106, whereupon the air 400 may impart thermal energy to and/or receive moisture from the articles and/or the wash chamber 106. More particularly, the dishwashing appliance 100 may be configured to provide air flow into the wash chamber 106 within the tub 104 alternately along two or more different paths during a drying cycle, such as four paths, as illustrated in FIGS. 3 through 6. As shown in FIG. 3, air 400 may flow into the wash chamber 106 via an inlet 166 and along a first path which is predominantly along the vertical direction V such that the air 400 is predominantly directed into an upper region 147 and onto articles in the upper rack 130. As shown in FIG. 4, air 400 may flow into the wash chamber 106 via the inlet 166 and along a second path which is oblique to the vertical direction V, such that the air 400 is directed approximately equally onto articles in each rack 130 and 132. As shown in FIG. 5, air 400 may flow into the wash chamber 106 via the inlet 166 and along a third path which is predominantly perpendicular to the vertical direction V such that the air 400 is predominantly directed into the lower region 146 and onto articles in the lower rack 132. As shown in FIG. 6, air 400 may flow into the wash chamber 106 via the inlet 166 and along a third path which is oblique to the vertical direction V such that the air 400 is directed into both the upper region 147 and the lower region 146, but mostly into the lower region 146, e.g., with a ratio of about 2:1 in favor of the lower region 146. In other embodiments, the fourth path may favor the upper region 147 instead of the lower region 146 and/or a fifth path may be provided where the air flow ratio between the upper and lower regions 147 and 146 is inverse of the ratio in the fourth path. In various exemplary embodiments, the drying cycle may include sequentially providing air flow into the wash chamber 106 along at least two different paths, such as along each of the first, second, third, and fourth paths. The air flow may be provided in any order, e.g., the sequence may begin with any of the first or second paths, as well as the third, fourth, or fifth paths in embodiments where more than two air flow paths are provided. In at least some embodiments, the dishwashing appliance 100 may be configured to provide generally the same air flow rate into the wash chamber 106 along each path.

Figure 8:
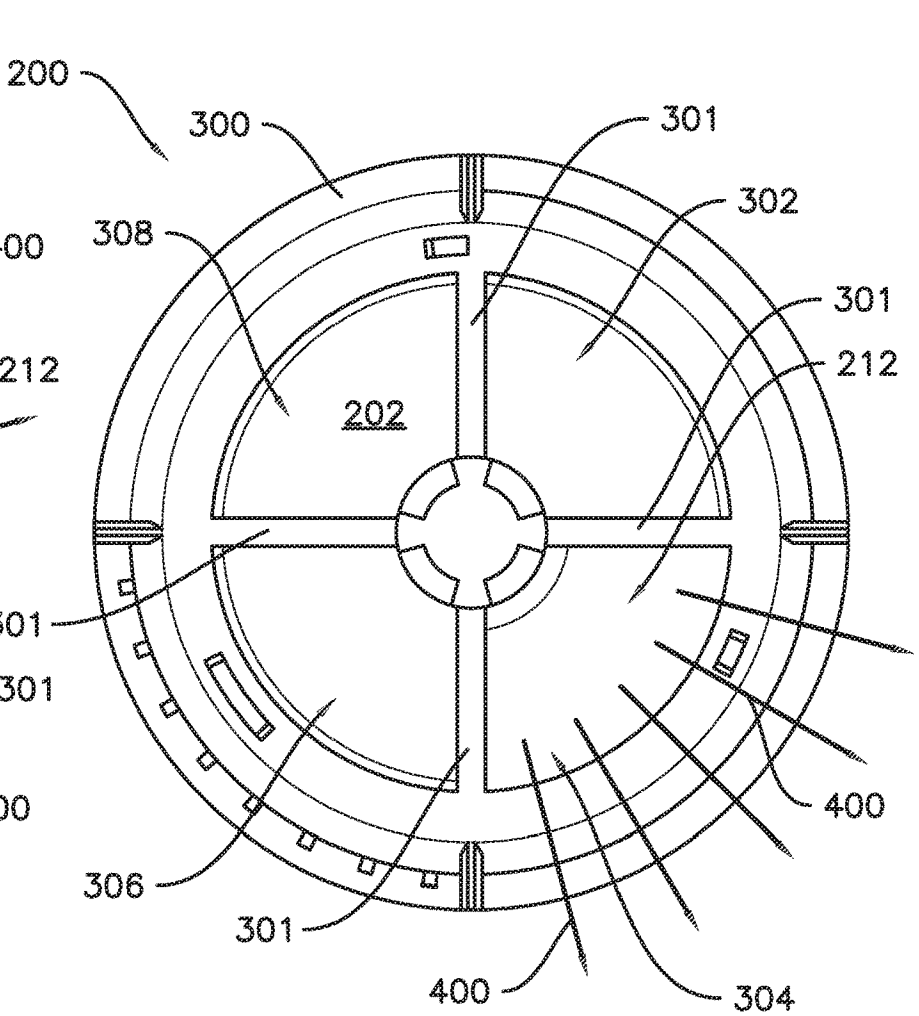
FIG. 8 provides a front view of the air distribution system of FIG. 7 in the second position.
Figure 7:
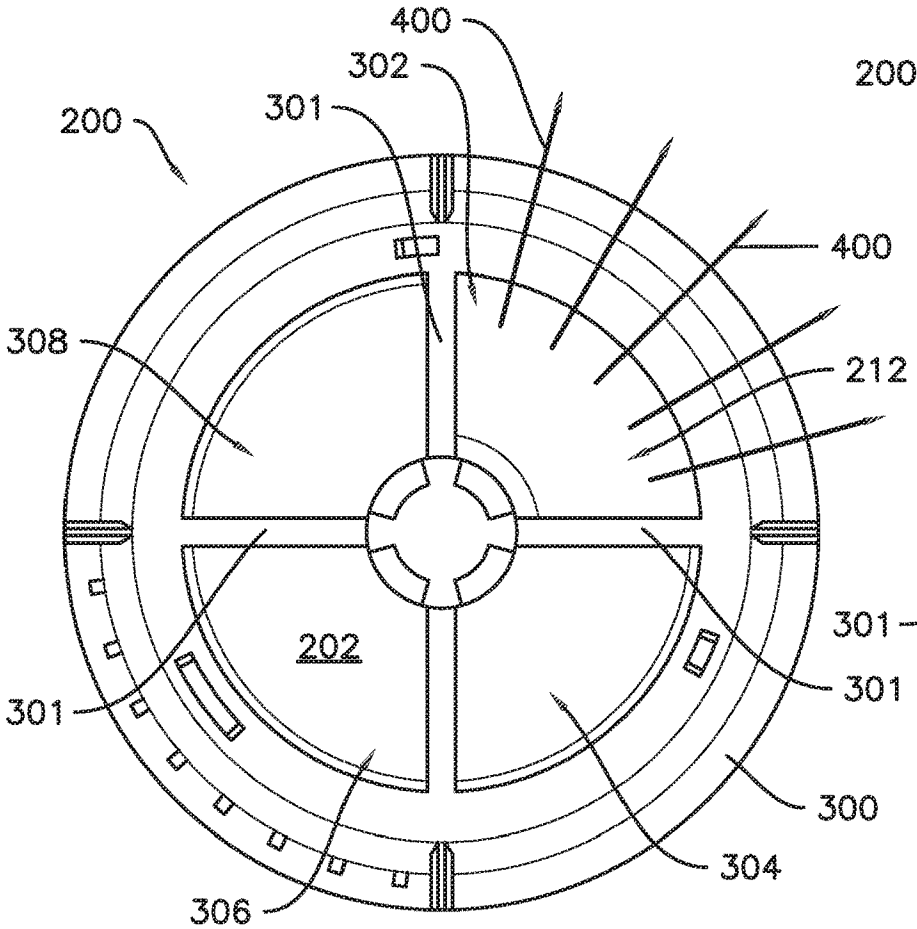
FIG. 7 provides a front view of an air distribution system for a dishwashing appliance according to one or more embodiments of the present subject matter in the first position.
Figure 10:
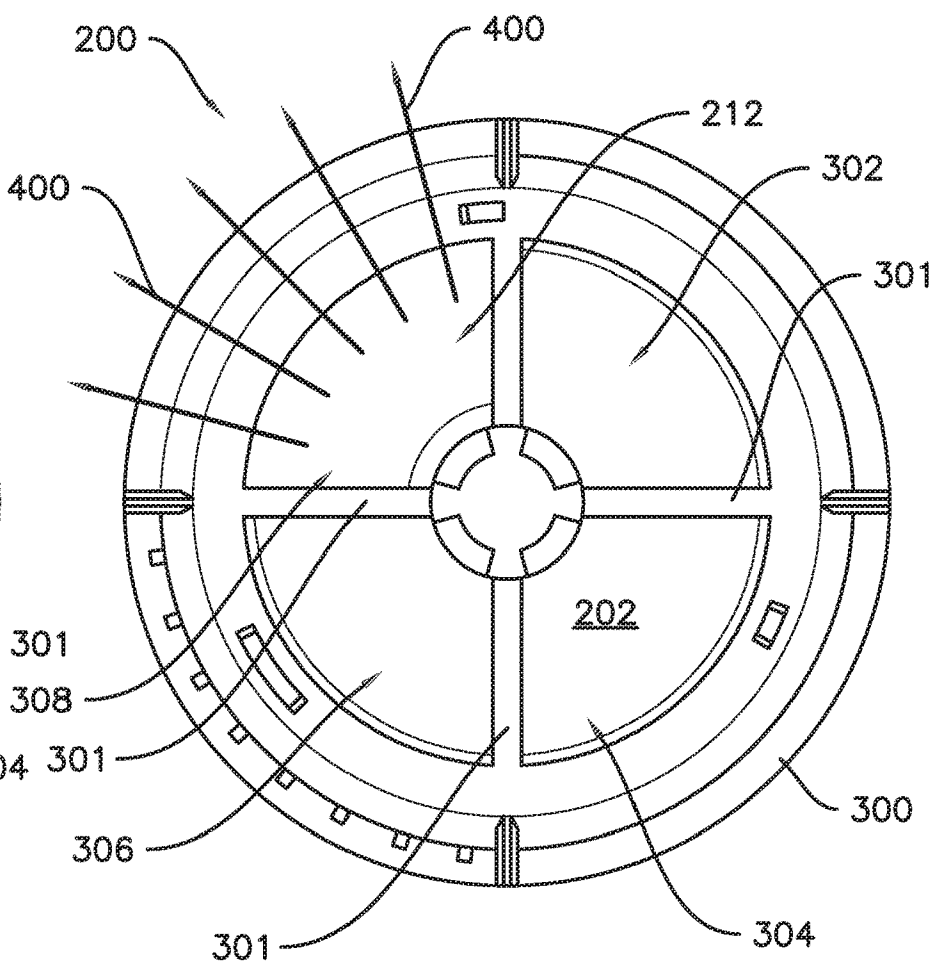
FIG. 10 provides a front view of the air distribution system of FIG. 7 in the fourth position.
Figure 9:
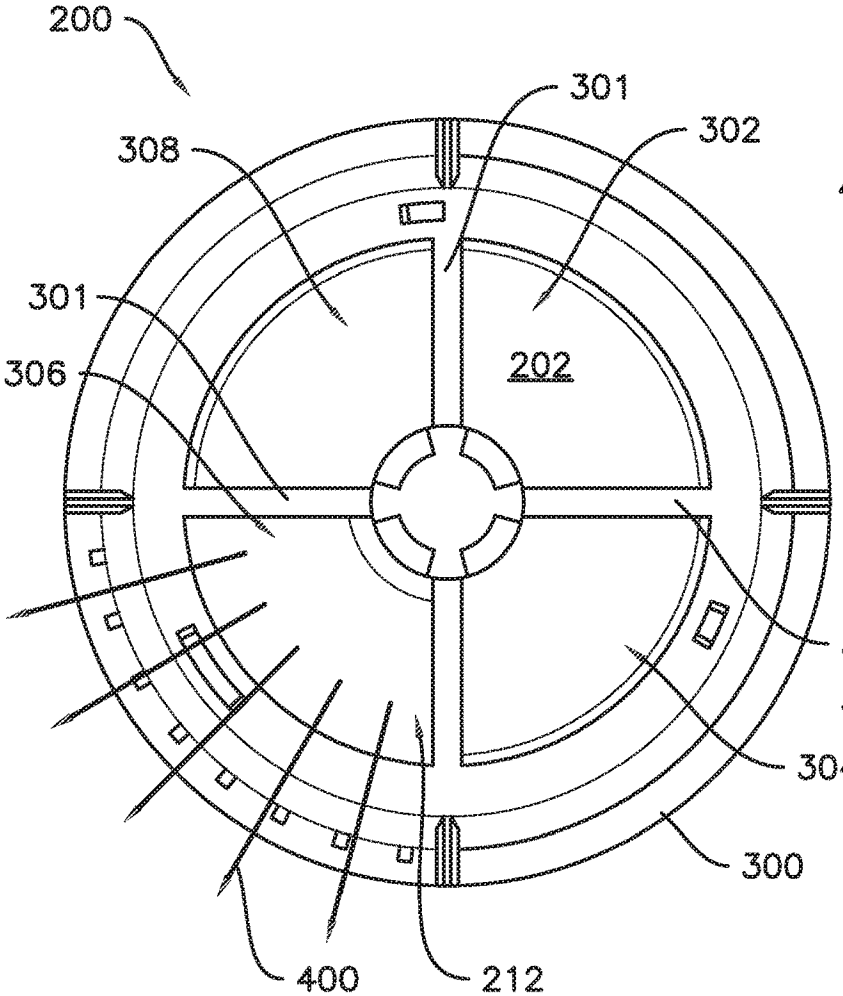
FIG. 9 provides a front view of the air distribution system of FIG. 7 in the third position.
Figure 25:
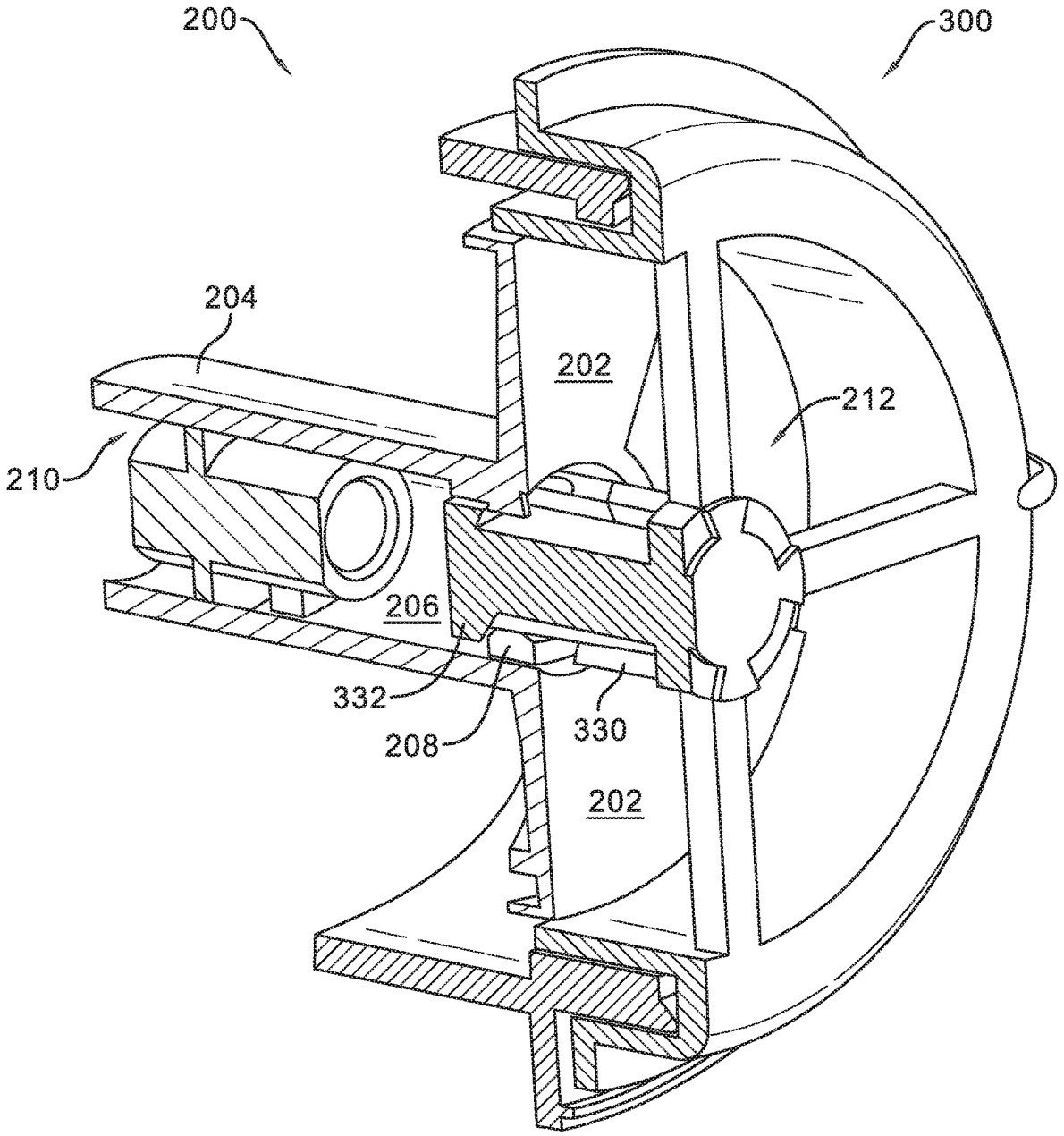
FIG. 25 provides a partially sectioned perspective view of a portion of the dishwashing appliance of FIG. 21 with the diverter in the second axial position and a second circumferential position.

As shown in FIGS. 7 through 10, the air 400 may be selectively directed along different paths, e.g., one of the four different paths described above, by an air distribution assembly 200 including a diverter disk 202 and a vent 300. The selected path along which the air 400 is directed may be based on a circumferential position of the diverter disk 202. The diverter disk 202 may be rotatably mounted in or proximate to the vent 300 such that the diverter disk 202 rotates between a plurality of circumferential positions. In at least some embodiments, the diverter disk 202 may be passively rotatable. For example, the diverter disk 202 may not be actively driven, e.g., by a motor or biasing element, between the multiple circumferential positions. For example, the diverter disk 202 may rotate between a first circumferential position and a second circumferential position (and other subsequent positions as well, such as to provide air flow along the multiple paths described above) in response to air flow driven by a fan 250 (e.g., FIGS. 22 and 23) upstream of the diverter disk 202. The second circumferential position is shown in FIG. 25. The vent 300 may be located at the inlet 166 into the wash chamber 106. With the vent 300 located at the inlet 166, the diverter disk 202 mounted in or to the vent 300 is disposed proximate the inlet 166 and upstream of the wash chamber 166. In some embodiments, for example as illustrated in FIGS. 7 through 10, the vent 300 may comprise a plurality of arms 301 which define multiple outlets of the vent. For example, the arms 301 may divide the vent 300 into four quadrants 302, 304, 306, and 308, as shown in FIGS. 7 through 10. In some embodiments, the diverter disk 202 may include a single aperture 212. For example, in some embodiments, the diverter disk 202 may be circular and the aperture 212 may extend along an arc of approximately ninety degrees. In embodiments where the vent 300 includes the four quadrants 302, 304, 306, and 308 and the diverter disk 202 includes the single aperture 212, the diverter disk 202 may rotate through four circumferential positions to align the aperture 212 with each quadrant 302, 304, 306, and 308 of the vent 300 in sequence and another four intermediate circumferential positions, for a total of eight circumferential positions. The eight circumferential positions may be spaced apart by about forty-five degrees. As also described above with reference to FIGS. 3 through 6, air 400 may flow along the first path when the aperture 212 of the diverter disk 202 is aligned with the first quadrant 302 of the vent 300, e.g., as shown in FIG. 7, where the diverter disk 202 is in a first circumferential position. As shown in FIG. 8, air 400 may flow along the second path when the diverter disk 202 is in a third circumferential position after passing through an intermediate second circumferential position between the first and third circumferential positions. In the third circumferential position, as shown in FIG. 8, the aperture 212 of the diverter disk 202 is aligned with the second quadrant 304 of the vent 300. As shown in FIG. 9, air 400 may flow along the third path when the aperture 212 of the diverter disk 202 is in a fifth circumferential position and aligned with the third quadrant 306 of the vent 300. As shown in FIG. 10, air 400 may flow along the fourth path when the aperture 212 of the diverter disk 202 is in a seventh circumferential position and aligned with the fourth quadrant 308 of the vent 300. The diverter disk may further travel through an intermediate eighth circumferential position and then return to the first circumferential position of FIG. 7. The air distribution assembly 200 may be configured to provide generally the same air flow rate into the wash chamber along each path. For example, the quadrants 302, 304, 306, and 308 of the vent may be generally equivalent in size, in particular in cross-sectional area, such that the rate of air flow through the vent 300 is generally the same when the aperture 212 is aligned with each quadrant 302, 304, 306, and 308.

Figure 11:
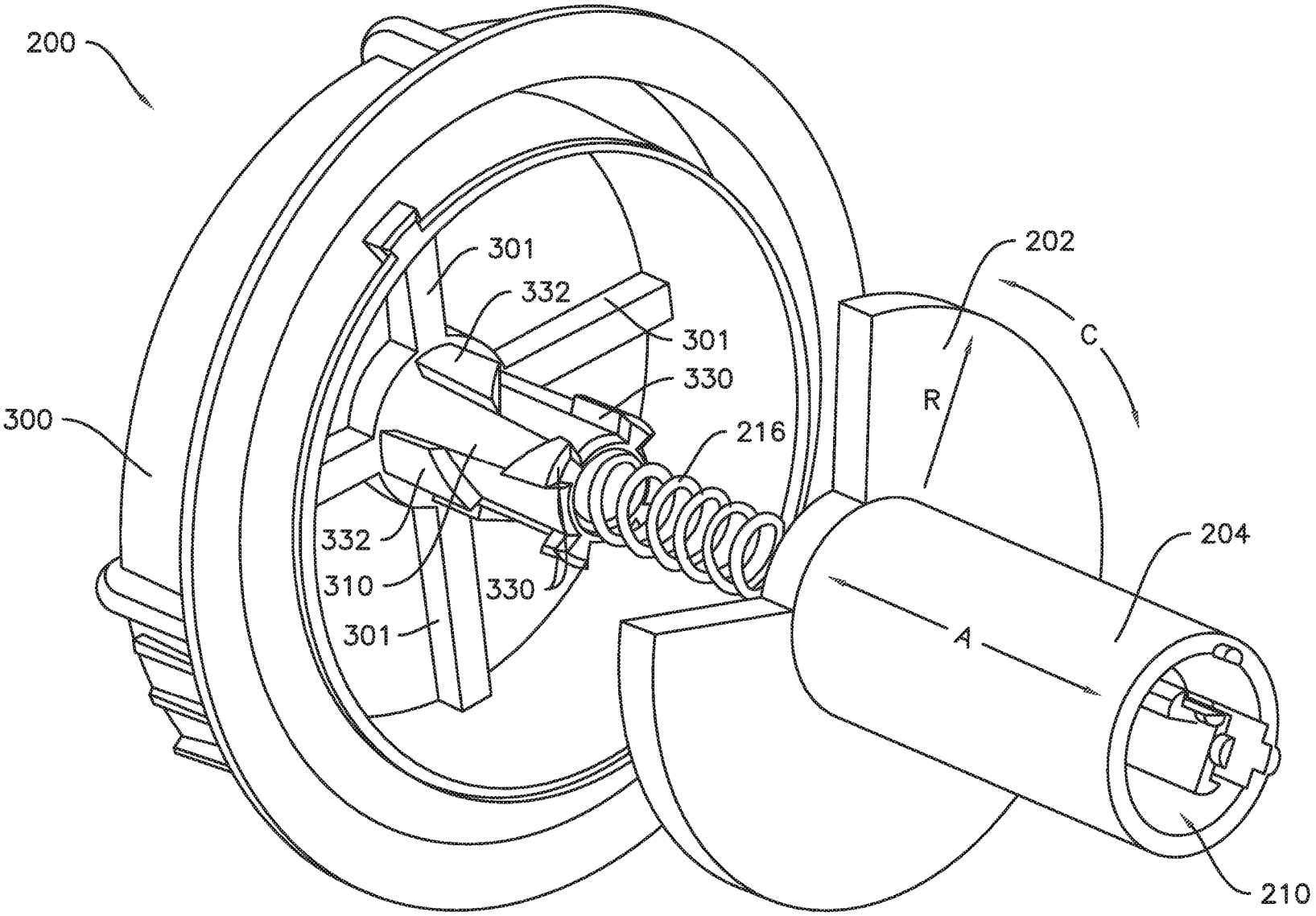
FIG. 11 provides a rear perspective view of a vent and a diverter of an air distribution system for a dishwashing appliance according to one or more embodiments of the present subject matter.
Figure 12:
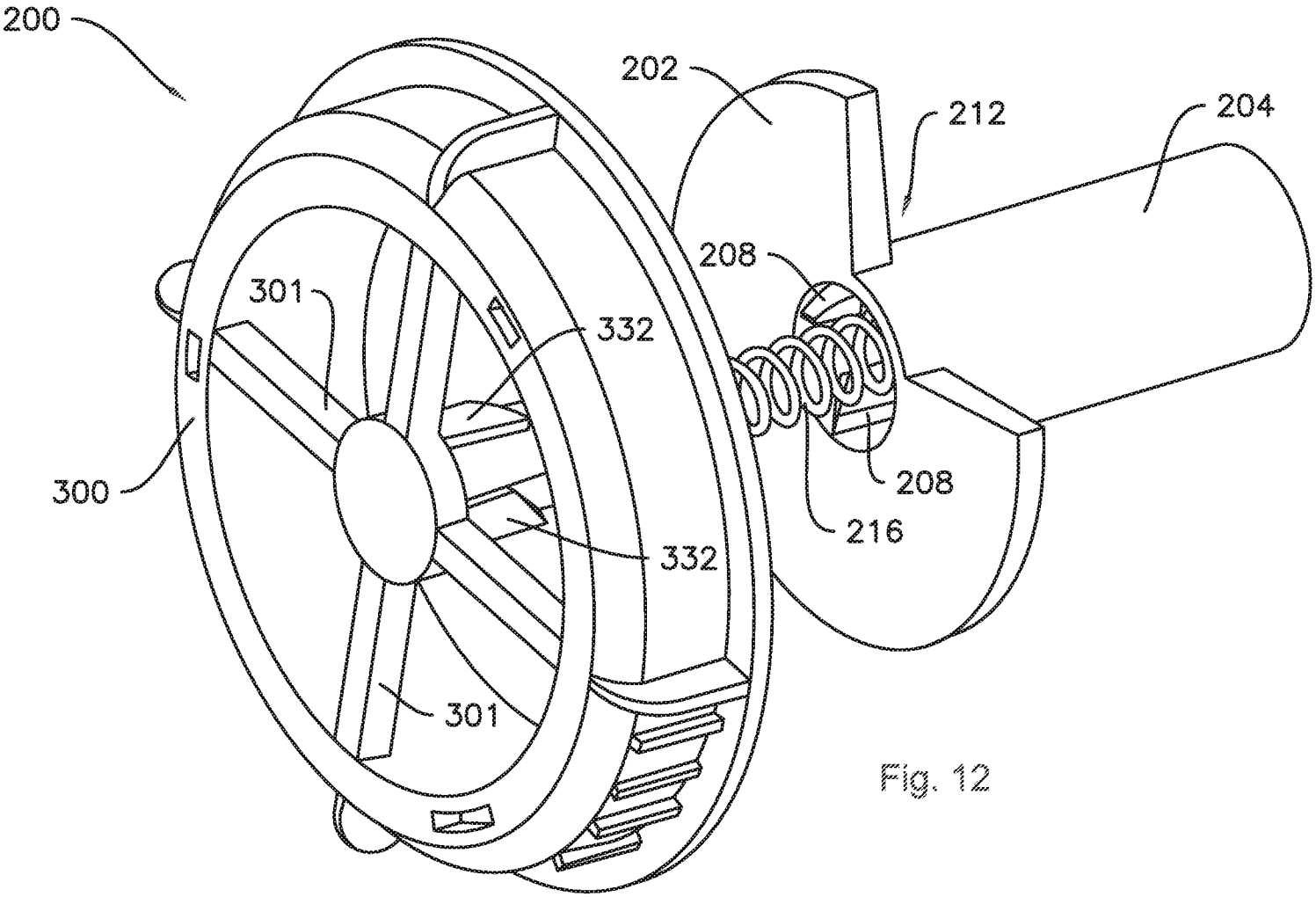
FIG. 12 provides a front perspective view of the vent and diverter of FIG. 11.

FIG. 11 provides an exploded view of an exemplary air distribution assembly 200 including a diverter disk 202, vent 300, and an optional biasing element 216 between the diverter disk 202 and the vent 300. As seen in FIGS. 11 and 12, the diverter disk 202 may define an axial direction A, a radial direction R, and a circumferential direction C. The view of FIG. 11 is looking in a first direction along the axial direction A. FIG. 12 provides an exploded view of the air distribution assembly of FIG. 11 looking in a second direction along the axial direction A. More particularly, the diverter disk 202 includes a generally circular main body with at least one aperture 212 defined therein, the circumferential direction C defined by an outermost perimeter of the disk 202, and a cylindrical shaft 204 that extends along the axial direction A. The vent 300 may include a cylindrically-shaped boss 310 which extends along the axial direction A and includes a plurality of guide elements 330 and 332 that extend radially outward from the boss 310 and are spaced apart from each other along axial and circumferential directions A and C. The cylindrical shaft 204 may be configured to interengage with the boss 310, and in particular cams 208 (FIG. 12) on the cylindrical shaft 204 may engage the guide elements 330 and 332 on the boss 310, such that the diverter disk 202 is rotatable about the axial direction A, e.g., along the circumferential direction C, relative to vent 300 and movable back and forth along axial direction A, e.g., between a first axial position and a second axial position, as described in more detail below.

Figure 22:
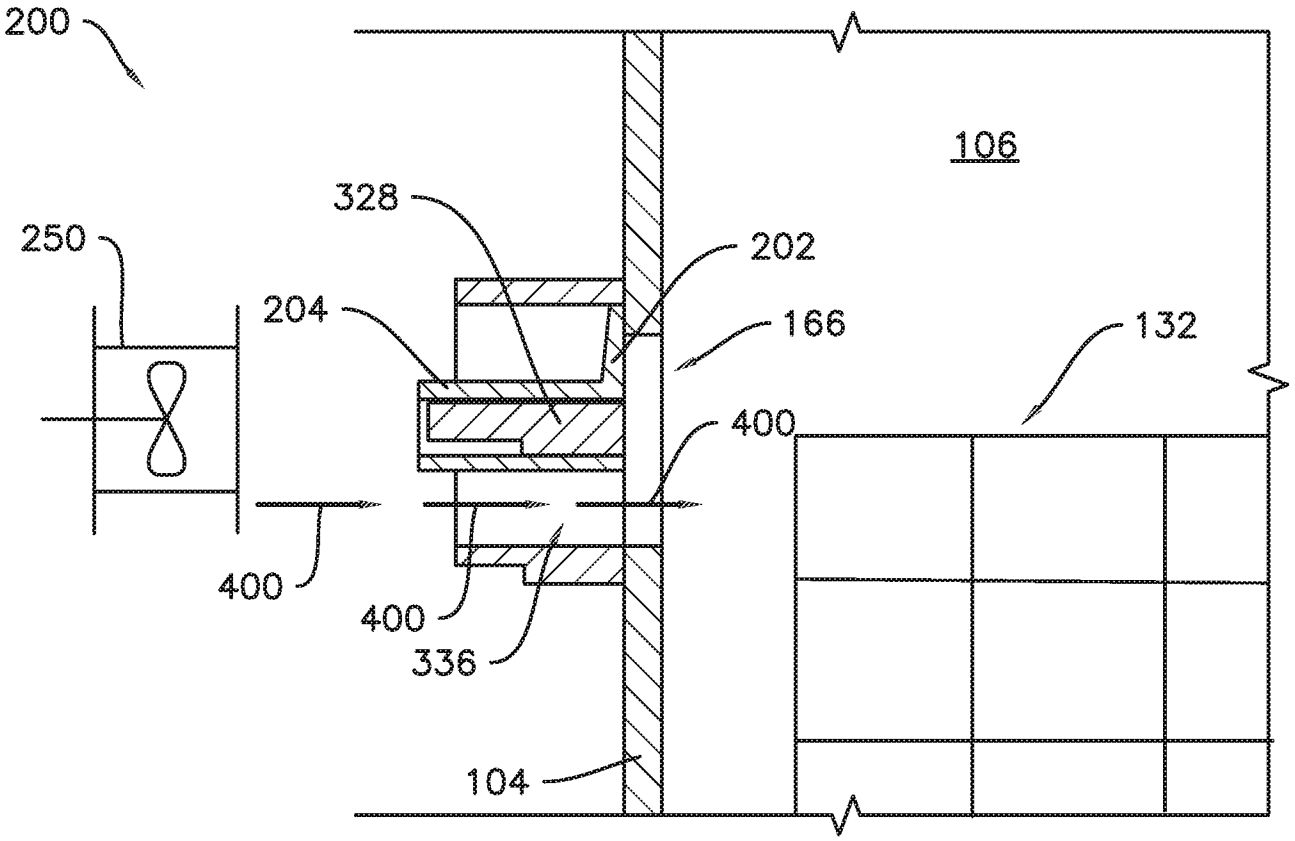
FIG. 22 provides a section view of a portion of the dishwashing appliance of FIG. 21 with a diverter in a first axial position.
Figure 23:
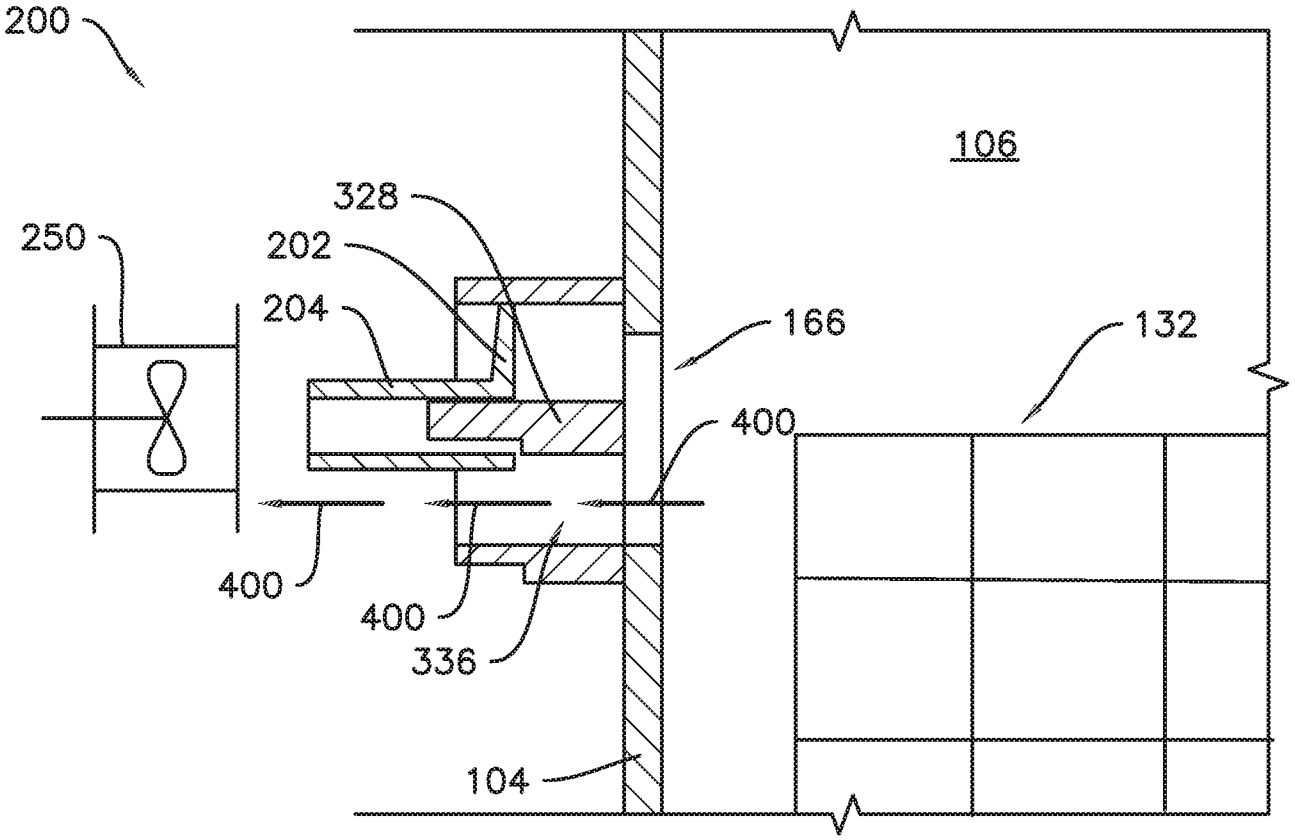
FIG. 23 provides a section view of a portion of the dishwashing appliance of FIG. 21 with the diverter in a second axial position.

In various embodiments, the diverter disk 202 may be configured to move along the axial direction A by the force of air flowing through the air distribution assembly 200, e.g., air urged by a fan 250 (FIGS. 22 and 23). The fan 250 may be a variable direction fan, e.g., the fan 250 may be configured to selectively urge the air along one of several possible different directions, such as at least two different directions, such as or three or more different directions. The fan 250 may be configured to alternate directions or cycle through the different possible directions in any desired sequence, e.g., a first direction followed by a second direction, followed by a third direction and then returning to the first direction. In various embodiments, any number of directions may be provided in any order. For example, the fan 250 may be configured to selectively urge air through the inlet 166 in one of a plurality of different directions. The plurality of different directions includes at least a first direction and a second direction. The second direction is different from the first direction. For example, the second direction may be generally orthogonal to the first direction, e.g., the first and second directions may be spaced apart by about ninety degrees (90°). As another example, the second direction may be opposite the first direction, e.g., the first and second directions may be spaced apart by about one hundred eighty degrees (180°). In some embodiments, the first direction may be oriented generally along the axial direction A (e.g., the direction of the view of FIG. 11) and the second direction may be opposite the first direction along the axial direction A (e.g., the direction of the view of FIG. 12). Thus, the diverter disk 202 may be configured to move in the first direction, e.g., towards the vent 300, when the fan 250 urges air through the inlet 166 in the first direction, and the diverter disk 202 may be configured to move in the second direction when the fan 250 urges air through the inlet 166 in the second direction. That is, the fan 250 may urge the diverter disk 202 to move from the second axial position to the first axial position when the fan 250 urges air through the inlet 166 in the first direction, and the fan 250 may urge the diverter disk 202 to move from the first axial position to the second axial position when the fan 250 urges air through the inlet 166 in the second direction. In some embodiments, the biasing element 216 may be configured and arranged to bias the diverter disk 202 along the axial direction A in the second direction opposite the first direction. The diverter disk 202 may rotate about the axial direction A, e.g., along the circumferential direction C, as it translates long the axial direction A. For example, the diverter disk 202 may rotate from the first circumferential position to the second circumferential position when it moves in the second direction along the axial direction A and may rotate from the second circumferential position to the third circumferential position when the diverter disk 202 moves in the first direction along the axial direction A, e.g., from the second axial position back to the first axial position, in response to the air flow from the fan 250.

Figure 13:
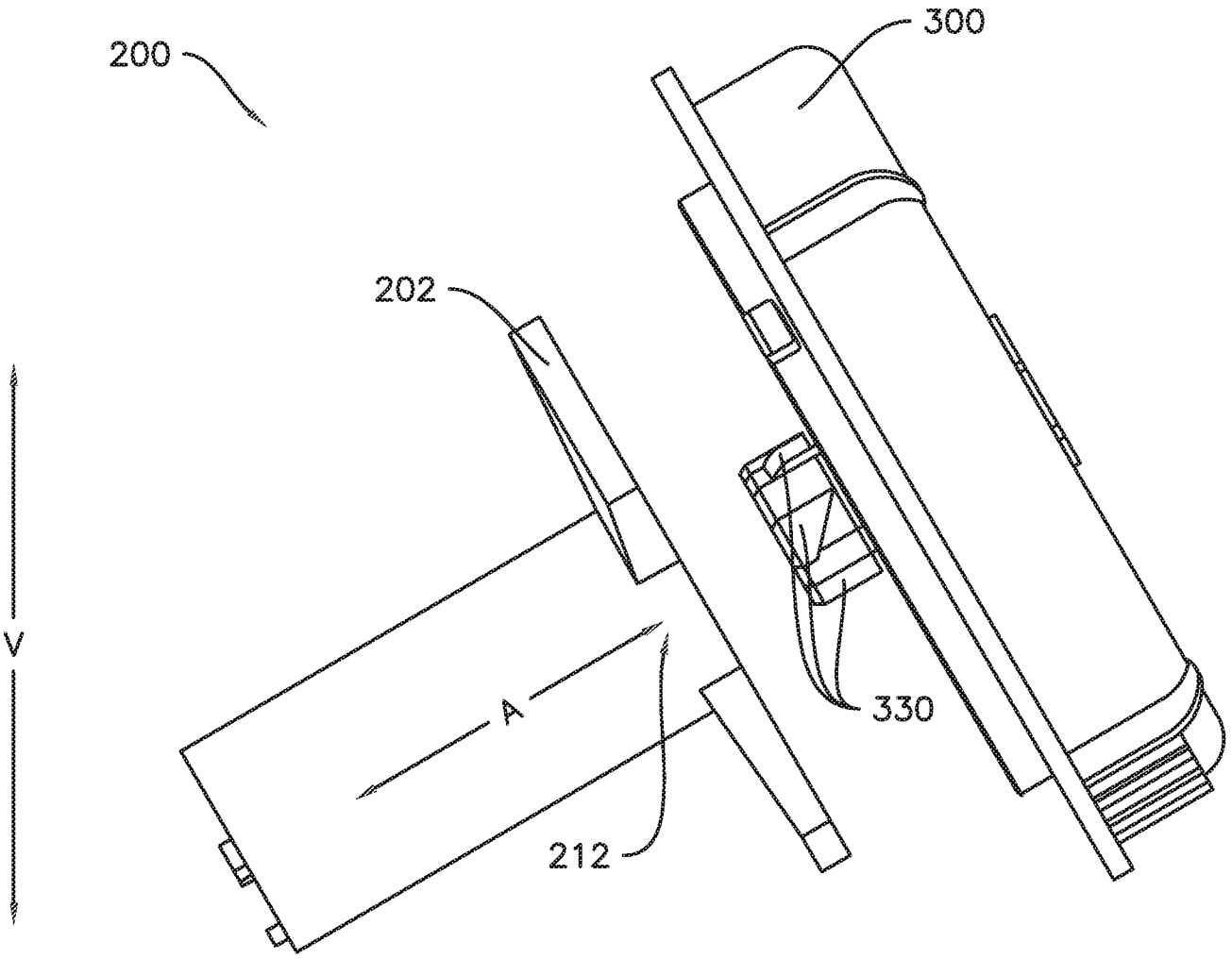
FIG. 13 provides a side view of a vent and a diverter of an air distribution system for a dishwashing appliance according to one or more additional embodiments of the present subject matter.
Figure 20:
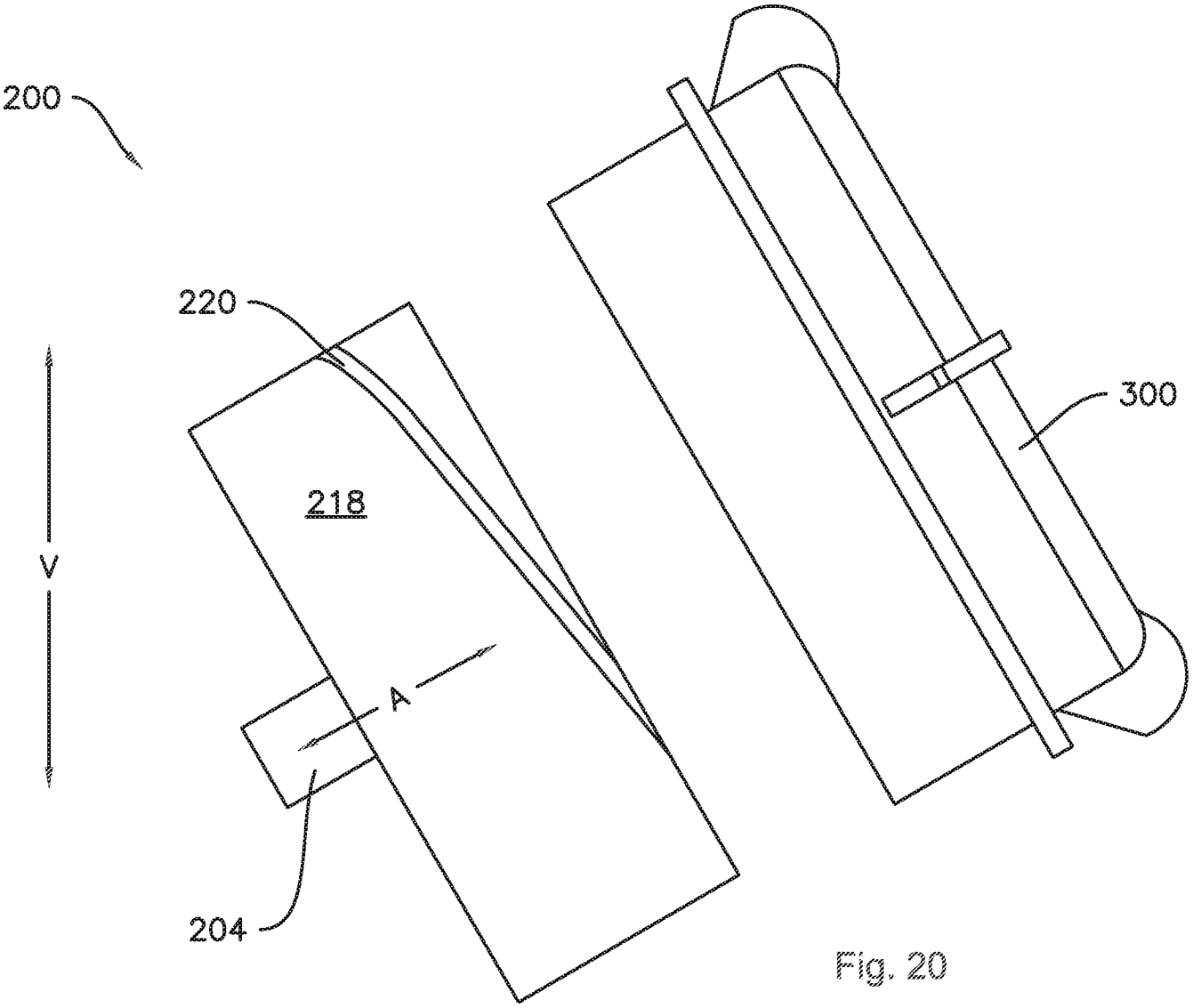
FIG. 20 provides a side view of a vent and a diverter of an air distribution system for a dishwashing appliance according to one or more additional embodiments of the present subject matter.

As shown in FIGS. 13 and 20, in some embodiments the air distribution assembly 200 may be positioned within the dishwashing appliance 100 such that the axial direction A of the diverter disk 202 is oblique to the vertical direction V. In such embodiments, the diverter disk 202 may thusly be configured to translate along the axial direction A to the second axial position from the first axial position due to gravity as well as the force of the air moving through the inlet 166 in the second direction when the axial direction A is oblique to the vertical direction V. In various embodiments, the diverter disk 202 may be moved from the first axial position to the second axial position by the fan 250 urging air in the second direction alone, or movement of the diverter disk 202 in the second direction may be assisted by the biasing element 216 and/or gravity.

Figure 15:
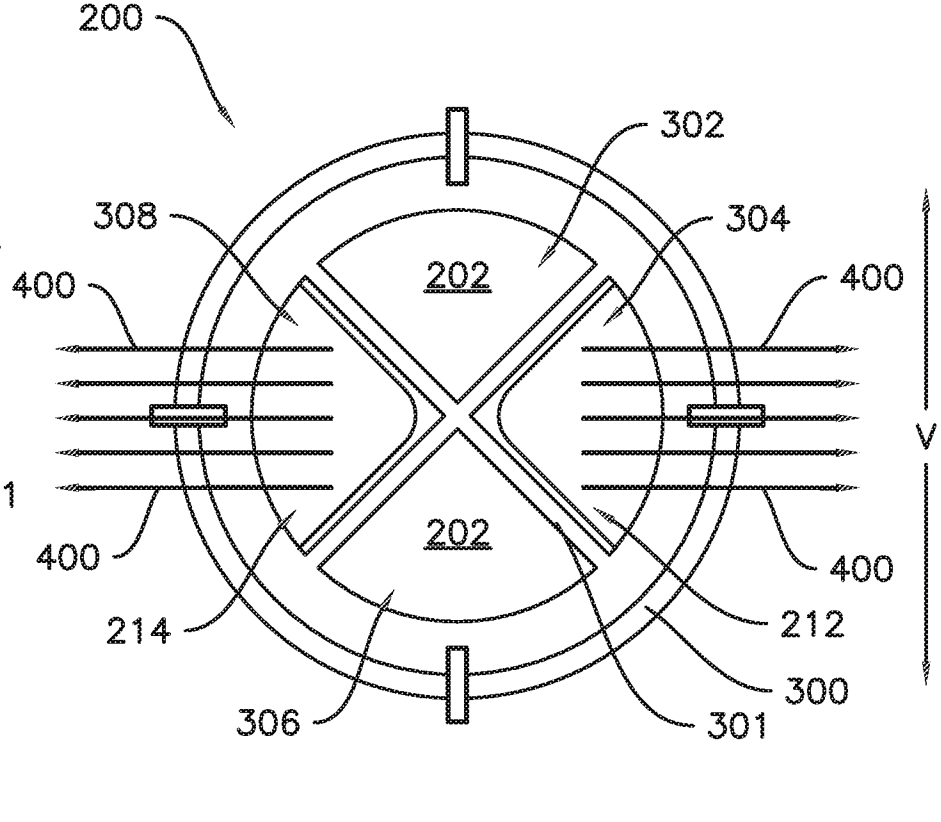
FIG. 15 provides a front view of the air distribution system of FIG. 14 in a second position.
Figure 14:
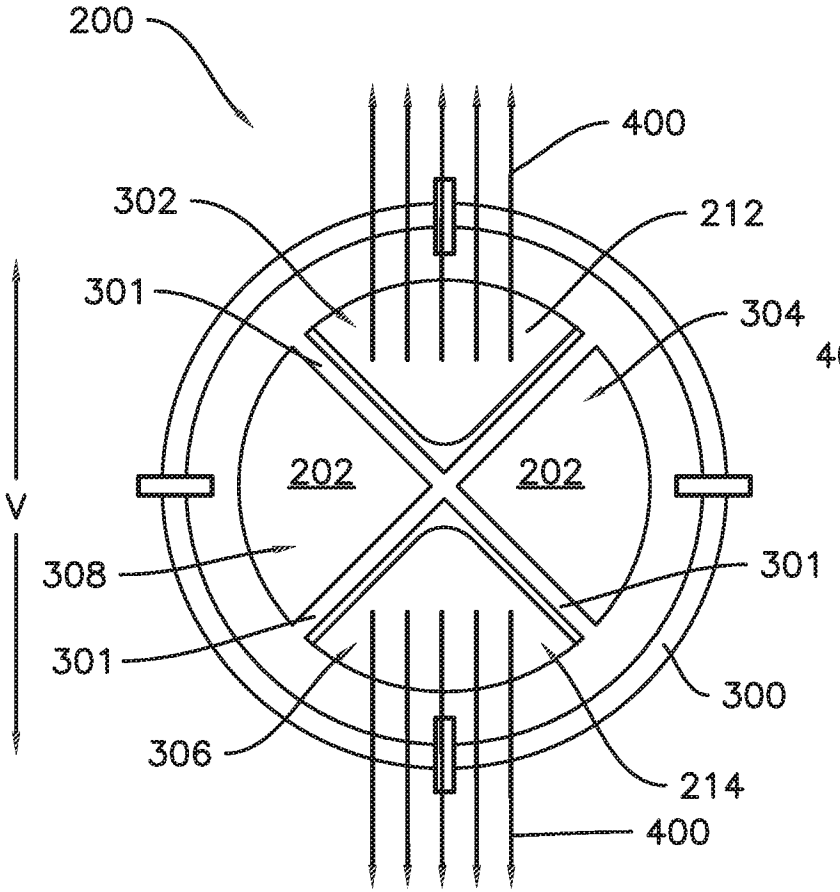
FIG. 14 provides a front view of an air distribution system for a dishwashing appliance according to one or more further additional embodiments of the present subject matter in a first position.
Figure 16:
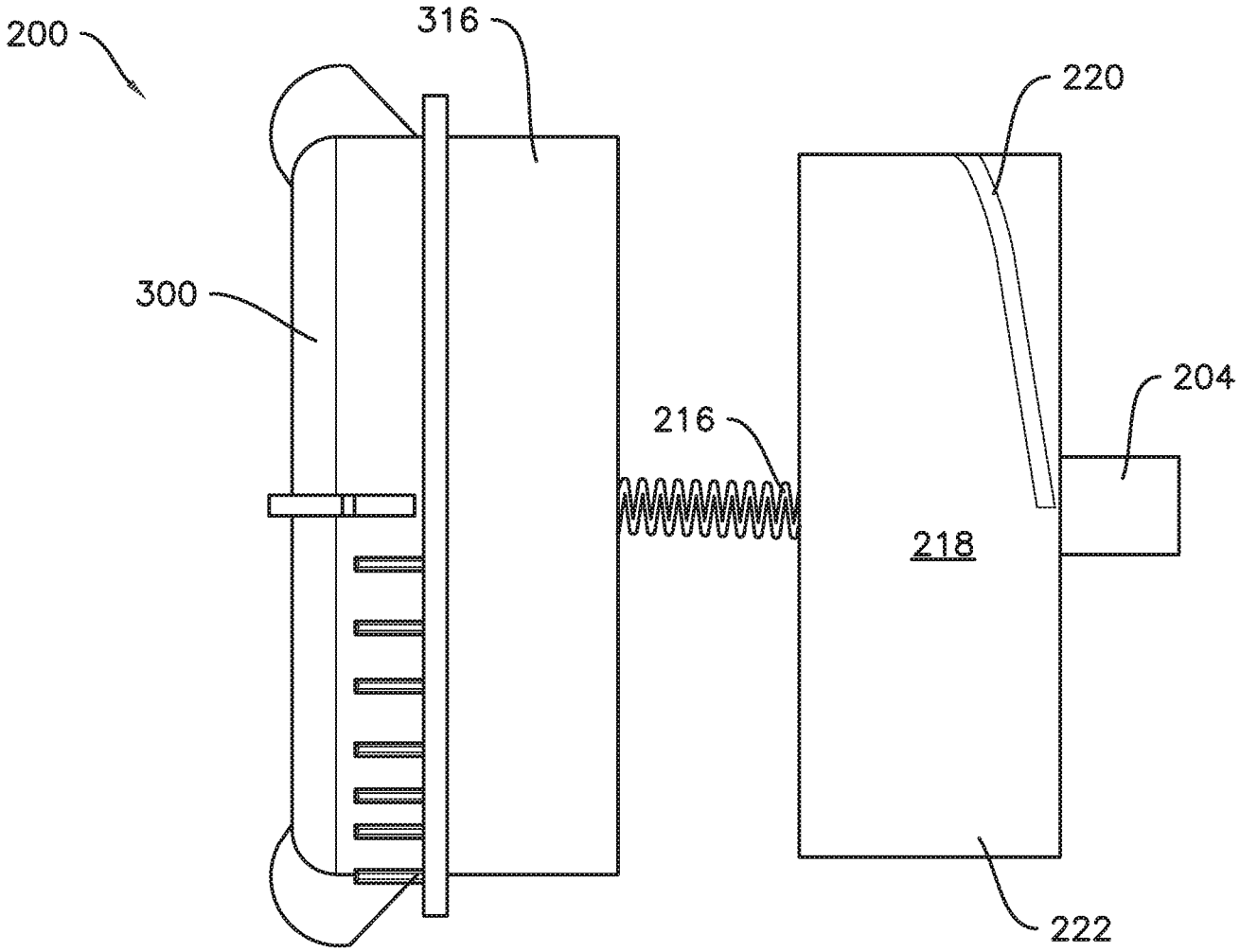
FIG. 16 provides a side view of the air distribution system of FIG. 14.
Figure 17:
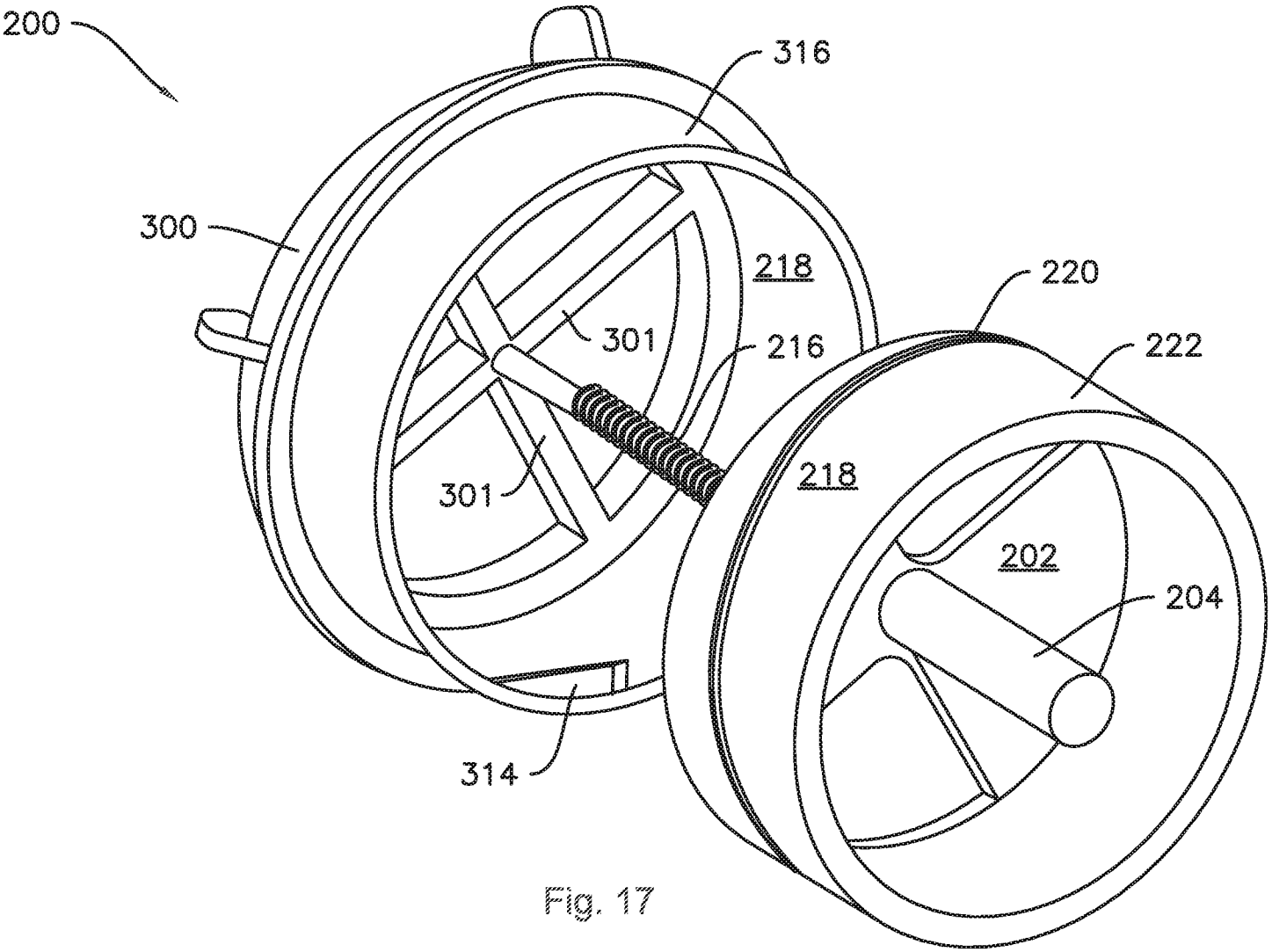
FIG. 17 provides a rear perspective view of the air distribution system of FIG. 14.

In some embodiments, the air flow distribution assembly 200 may be configured to provide only two air flow paths into the tub 104 of the dishwashing appliance 100. For example, the first path may be as shown in FIG. 14, and the second path may be as shown in FIG. 15. In such embodiments, the first airflow path may be generally vertical, e.g., generally along the vertical direction V, and the second path may be generally horizontal, e.g., generally perpendicular to the vertical direction V, such as along one of the lateral direction L and the transverse direction T. In such embodiments, the diverter disk 202 may include a first aperture 212 and a second aperture 214. The diverter disk 202 may be configured to provide generally the same air flow rate into the wash chamber 106 along each of the first path and the second path. For example, the first and second apertures 212 and 214 may be generally equivalent in size, e.g., cross-sectional area. For example, in some embodiments where the first aperture 212 extends along an arc of approximately ninety degrees along the circumferential direction C, the second aperture 214 may extend along an equivalent arcuate extent as the first aperture 212.

Additionally, the quadrants 302, 304, 306, and 308 of the vent 300 may be generally equivalent in size. Further, in embodiments such as illustrated in FIGS. 14 and 15, the quadrants 302, 304, 306, and 308 may be oriented such that a first pair of opposing quadrants, e.g., first quadrant 302 and third quadrant 306, are aligned along the vertical direction V, and a second pair of opposing quadrants, e.g., second quadrant 304 and fourth quadrant 308, are aligned along a direction perpendicular to the vertical direction V. In such embodiments, the diverter disk 202 may be rotatable between a first circumferential position where the first aperture 212 is aligned with the first quadrant 302 and the second aperture 214 is aligned with the third quadrant 306, to direct the air 400 vertically, as shown in FIG. 14, and a third circumferential position where the first aperture 212 is aligned with the second quadrant 304 and the second aperture 214 is aligned with the fourth quadrant 308, to direct the air along a horizontal path, as shown in FIG. 15.

As shown in FIGS. 16 through 20, the diverter disk 202 may include a cylindrical shroud 222. The cylindrical shroud 222 may define an external cylindrical surface 218 with a helical groove 220 extending around the external cylindrical surface 218. In such embodiments, the vent 300 may include an internal cylindrical surface 312 (FIG. 17) and a helical thread 314 (FIG. 17) on the internal cylindrical surface 312. As will be understood by those of ordinary skill in the art, the diverter disk 202 and the vent 300 may thereby be threadedly engaged, e.g., the helical thread 314 on the vent 300 may be configured to engage the helical groove 220 on the external cylindrical surface 218 of the diverter disk 202 such that the diverter disk 202 is rotatable relative to the vent 300 along a path guided and defined by the groove 220 and the thread 314. For example, in the embodiments illustrated in FIGS. 16 through 20, the diverter disk 202 is rotatable between a first circumferential position and a third circumferential position with an intermediate second circumferential position, e.g., as described above with respect to FIGS. 7 through 10, 14 and 15.

Figure 18:
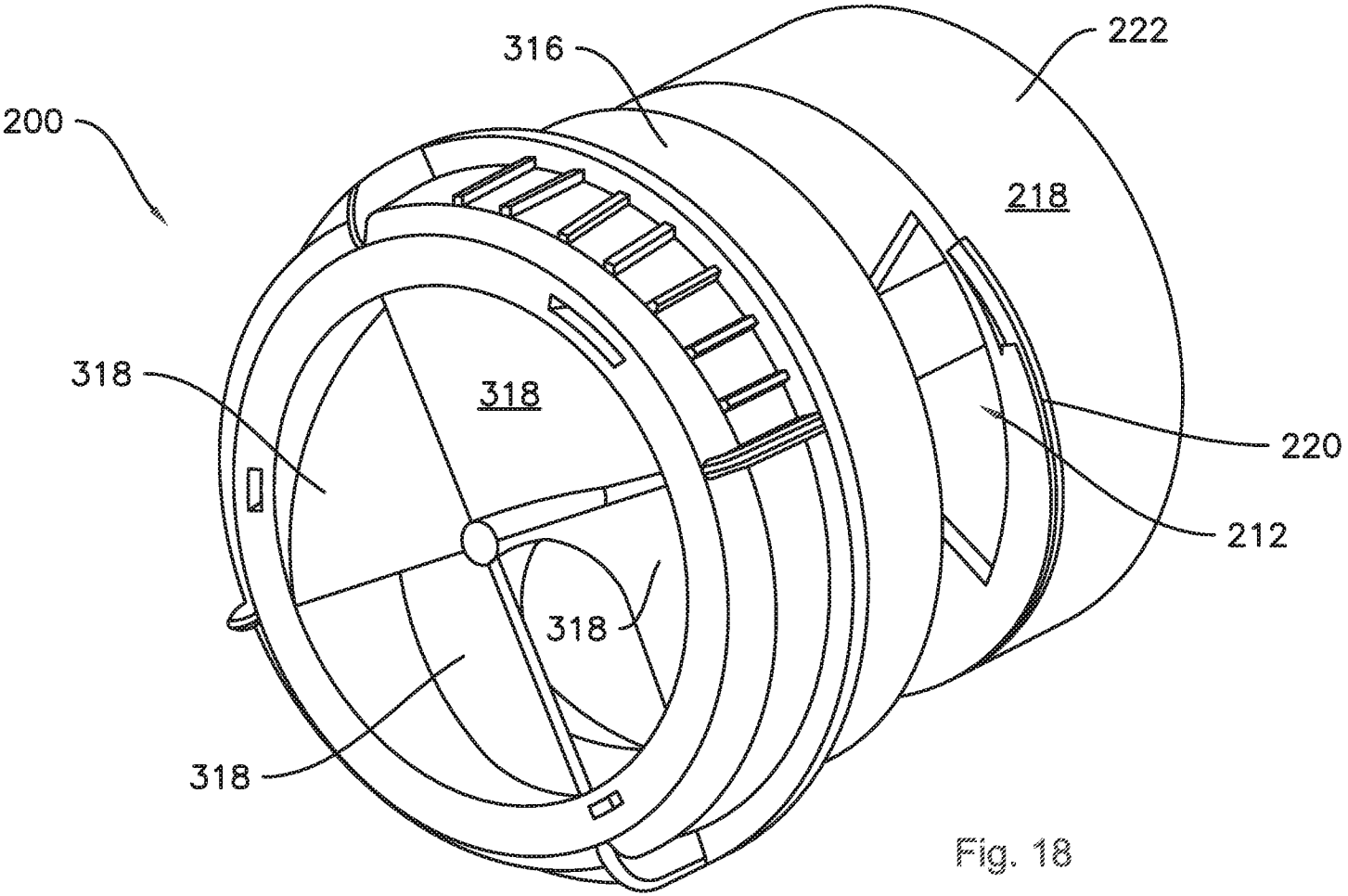
FIG. 18 provides a front perspective view of a vent and a diverter of an air distribution system for a dishwashing appliance according to one or more still further embodiments of the present subject matter.
Figure 19:
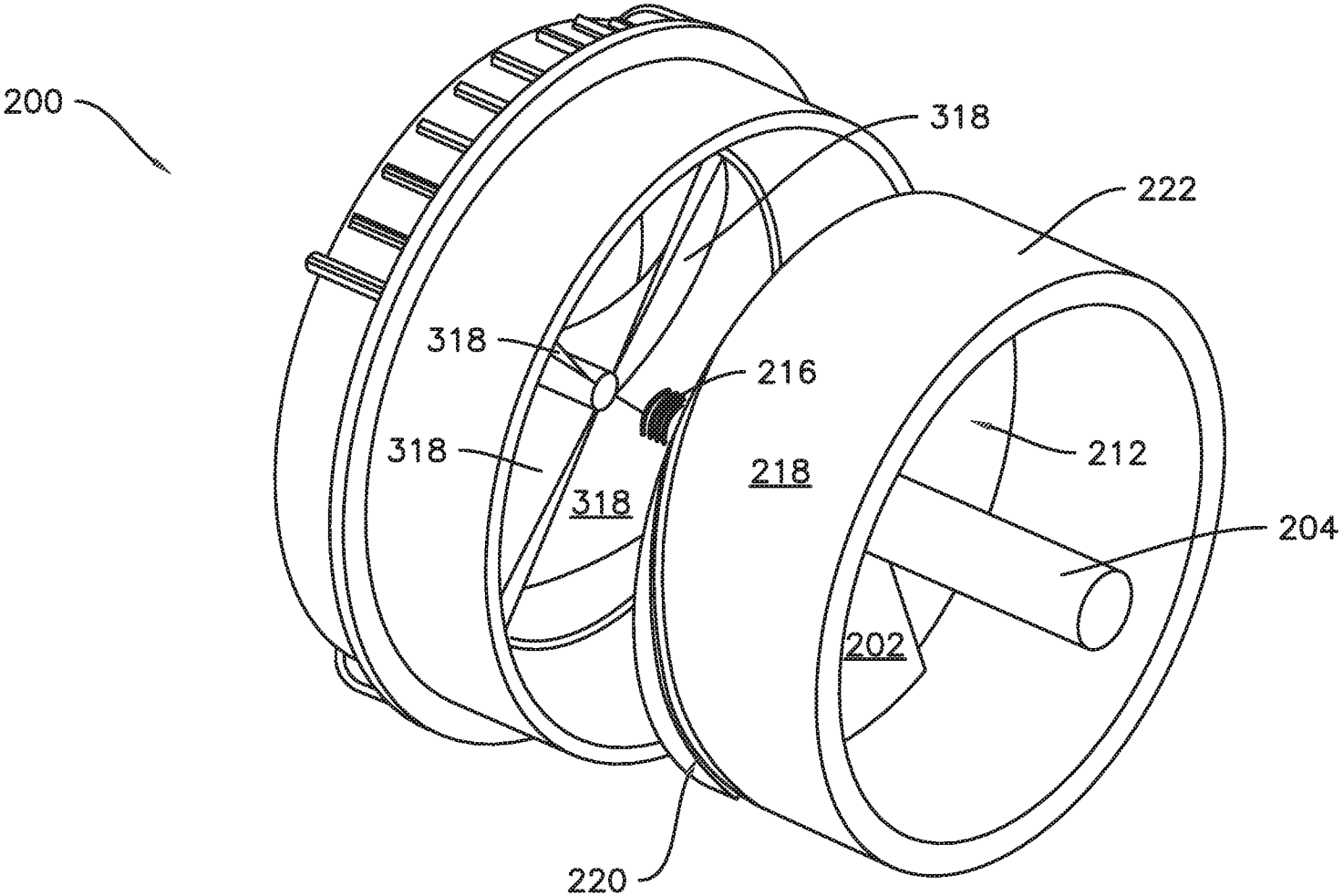
FIG. 19 provides a rear perspective view of the vent and diverter of FIG. 18.

In some embodiments, as shown in FIGS. 18 and 19, the vent 300 may include a plurality of swirler vanes 318. As is generally understood in the art, the swirler vanes 318 may each define a partial helical surface which imparts a swirl to air flowing out of the vent 300, e.g., the air may be directed along a path that is at least partially along the circumferential direction C by the swirler vanes 318.

Figure 21:
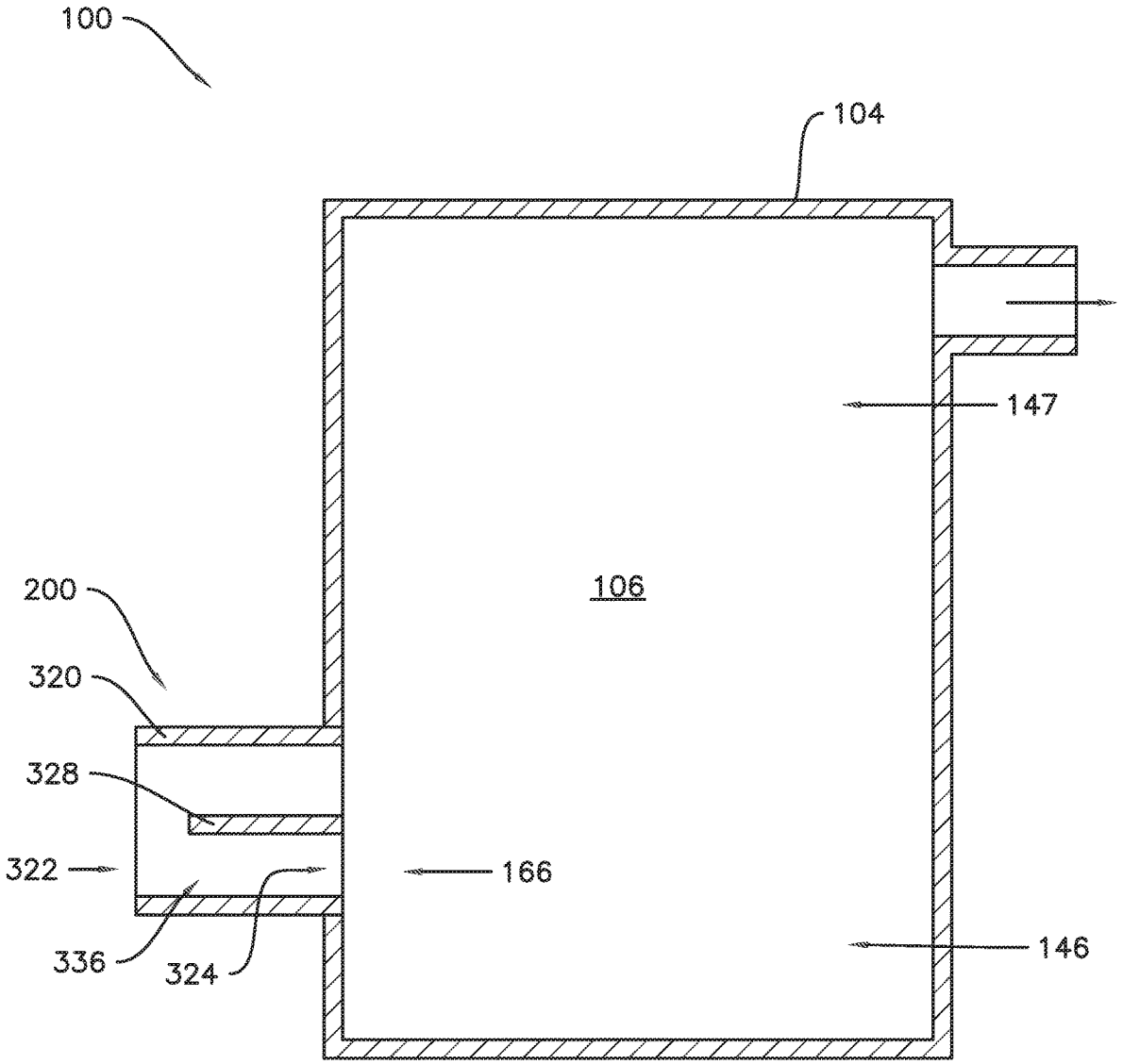
FIG. 21 provides a schematic view of a dishwashing appliance according to one or more additional embodiments of the present subject matter.

In some embodiments, as shown in FIG. 21, the dishwashing appliance 100 may also include a duct 320 upstream of the inlet 166 of the tub 104. The duct 320 may include an inlet 322 and an outlet 324 in fluid communication with the inlet 166 of the tub 104, and a second outlet 326 in fluid communication with the second inlet 167 of the tub 104.

As shown in FIGS. 22 and 23, in some embodiments the diverter disk 202 may be movable along the axial direction A between a first axial position (FIG. 22) and a second axial position (FIG. 23). For example, the dishwashing appliance 100 may include a fan 250 configured to urge the air 400 from an ambient environment around the dishwashing appliance 100 through the inlet 322 in one of the first direction and the second direction, and/or a third direction, etc., as mentioned above, such that the diverter disk 202 moves from the second axial position of FIG. 23 to the first axial position of FIG. 22 when the fan 250 urges air 400 through the inlet 166 in the first direction, and the diverter disk 202 moves from the first axial position to the second axial position when the fan 250 urges air 400 through the inlet 166 in the second direction.

Figure 24:
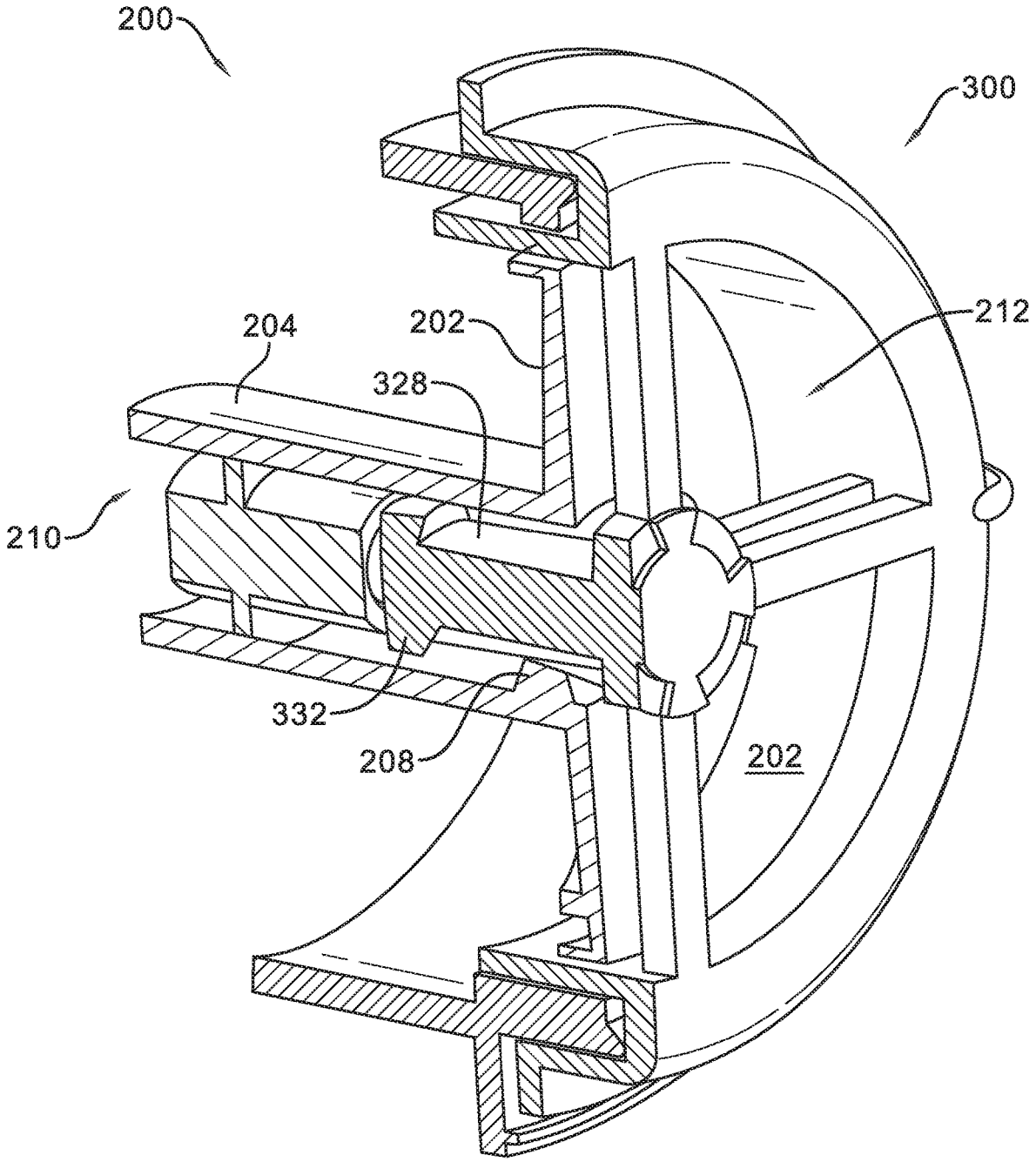
FIG. 24 provides a partially sectioned perspective view of a portion of the dishwashing appliance of FIG. 21 with the diverter in the first axial position and a first circumferential position.
Figure 26:
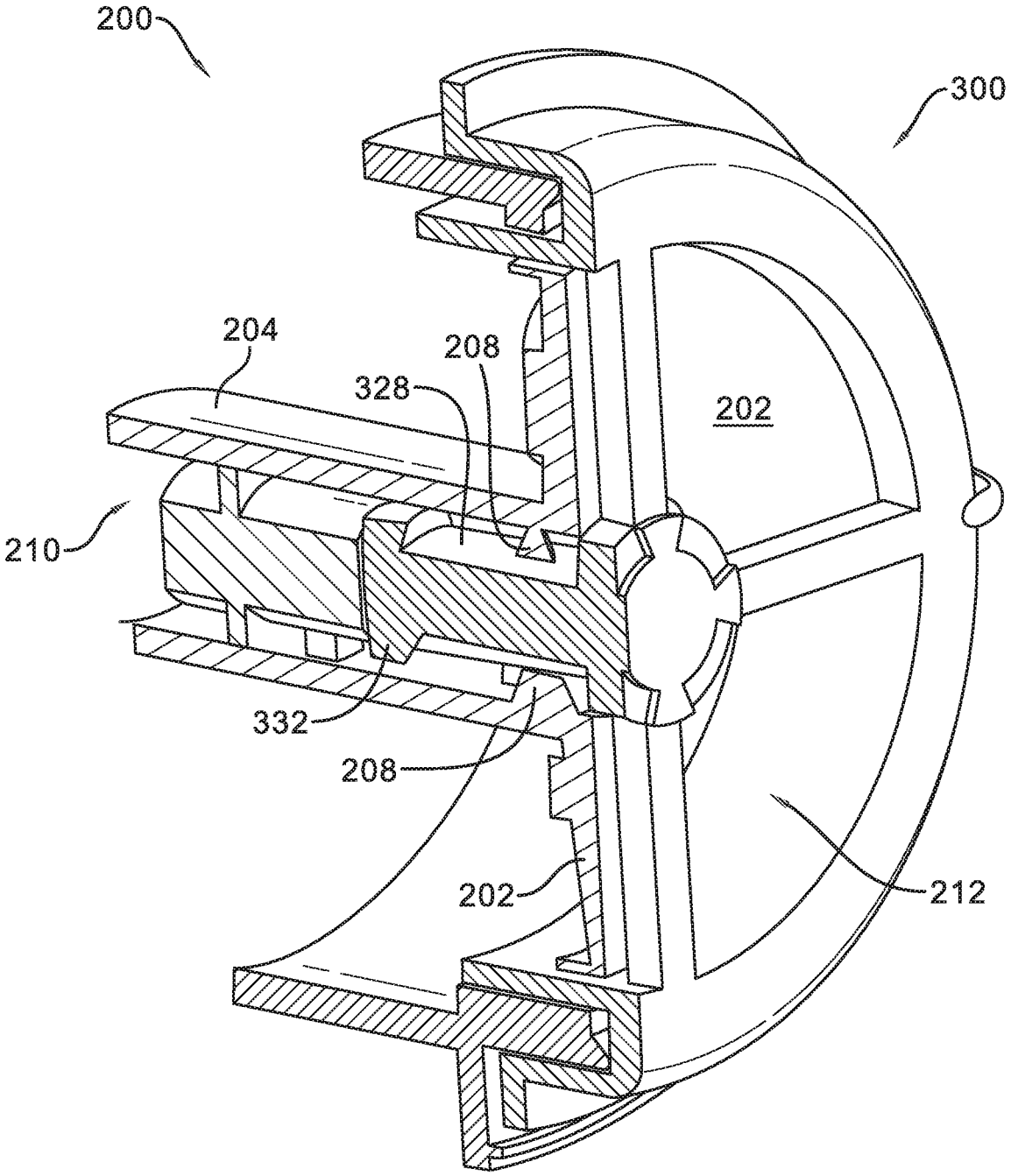
FIG. 26 provides a partially sectioned perspective view of a portion of the dishwashing appliance of FIG. 21 with the diverter in the first axial position and a third circumferential position.

As mentioned above, the cylindrical shaft 204 of the diverter disk 202 may be configured to interengage with guide elements 330 and 332, which in some embodiments are disposed on the boss 310 of the vent 300 and in other embodiments are disposed on a boss 328 of the duct 320. As best seen in FIG. 25, the cylindrical shaft 204 may be hollow such that the cylindrical shaft 204 defines an interior channel 210 with an internal surface 206. The diverter disk 202 may further include a plurality of cams 208 disposed on the internal surface 206 of the cylindrical shaft 204 and projecting radially inward from the internal surface 206 of the cylindrical shaft 204 into interior channel 210. As best seen in FIG. 12, each cam 208 is spaced apart from adjacent cams 208 along the circumferential direction C, and each cam 208 is at the same axial position along the axial direction A. Accordingly, as described herein, one of skill in the art will appreciate that the guide elements 330, 332 and the cams 208 are configured to contact each other when the diverter disk 202 moves along the axial direction A so as to cause the diverter disk 202 to rotate incrementally through a plurality of angular positions, e.g., to rotate forty five degrees from the first circumferential position (FIG. 24) to the second circumferential position (FIG. 25) as diverter disk 202 travels along the axial direction from the first axial position to the second axial position and to rotate an additional forty five degrees when the diverter disk 202 returns from the second axial position to the first axial position, thereby completing a ninety-degree rotation, such as from the first circumferential position of FIG. 7 or FIG. 24 to the third circumferential position of FIG. 8 or FIG. 26.

The air distribution assembly 200 may be configured to provide generally the same air flow rate into the wash chamber 106 when the diverter disk 202 is in either of the first circumferential position and the third circumferential position. For example, in embodiments where the diverter disk 202 includes multiple apertures, e.g., as illustrated in FIGS. 14-20, the apertures may be equally sized, e.g., may have an equivalent or generally equivalent arcuate extent along the circumferential direction C.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A dishwashing appliance, comprising:

a tub defining a wash chamber;

an inlet defined in the tub and providing air flow into the wash chamber;

a fan configured to selectively urge air through the inlet in a plurality of directions, the plurality of directions including at least a first direction and a second direction different from the first direction; and a diverter disk comprising an aperture, the diverter disk positioned proximate the inlet between the fan and the wash chamber, the diverter disk defining an axial direction, the diverter disk movable along the axial direction between a first position and a second position, wherein the diverter disk is spaced apart from the fan, wherein the diverter disk is configured to move from the second position to the first position when the fan urges air through the inlet in the first direction, and to move from the first position to the second position when the fan urges air through the inlet in the second direction, whereby the fan urges the diverter disk to move from the second position to the first position as the fan urges air through the inlet in the first direction, and the fan urges the diverter disk to move from the first position to the second position as the fan urges air through the inlet in the second direction, and wherein, in the first position of the diverter disk, the aperture in the diverter disk is aligned with the inlet and a first air flow path is thereby defined through both the aperture and the inlet by both the aperture and the inlet and, in the second position of the diverter disk, the aperture in the diverter disk is aligned with the inlet and a second air flow path is thereby defined through both the aperture and the inlet by both the aperture and the inlet.

2. The dishwashing appliance of claim 1, wherein the diverter disk is configured to rotate about the axial direction as the diverter disk moves between the first position and the second position.

3. The dishwashing appliance of claim 1, wherein the diverter disk is configured to rotate about the axial direction by about forty-five degrees each time the diverter disk moves from one of the first position and the second position to the other of the second position and the first position.

4. The dishwashing appliance of claim 1, wherein the diverter disk defines a circumferential direction extending around the axial direction, wherein the first position is a first axial position and the second position is a second axial position, wherein the diverter disk is configured to rotate along the circumferential direction from a first circumferential position to a second circumferential position when the diverter disk moves from the first axial position to the second axial position, and to move from the second circumferential position to a third circumferential position when the diverter disk moves from the second axial position to the first axial position, and wherein the diverter disk permits air flow into the wash chamber via the inlet along the first air flow path when the diverter disk is in the first circumferential position and along a third air flow path when the diverter disk is in the third circumferential position.

5. The dishwashing appliance of claim 1, wherein the dishwashing appliance defines a vertical direction, and the axial direction of the diverter disk is oblique to the vertical direction, whereby the diverter disk moves from the first position to the second position due to the air urged through the inlet in the second direction and due to gravity.

6. The dishwashing appliance of claim 1, wherein the diverter disk defines a circumferential direction, and wherein the aperture extends along an arc of approximately ninety degrees along the circumferential direction.

7. The dishwashing appliance of claim 6, wherein the aperture is a first aperture and the diverter disk further comprises a second aperture diametrically opposite the first aperture along a diameter of the diverter disk, the second aperture extending along an equivalent arcuate extent as the first aperture.

8. The dishwashing appliance of claim 1, further comprising a vent positioned at the inlet, and wherein the diverter disk further comprises an external cylindrical surface and a helical groove extending around the external cylindrical surface, and wherein the vent comprises an internal cylindrical surface and a helical thread on the internal cylindrical surface configured to engage the helical groove on the external cylindrical surface of the diverter disk.

9. The dishwashing appliance of claim 1, further comprising a vent positioned at the inlet, the vent comprising a plurality of swirler vanes.

10. The dishwashing appliance of claim 1, wherein the diverter disk comprises a cylindrical shaft defining an interior channel having a plurality of cams disposed on an internal surface of the cylindrical shaft and projecting radially inward from the internal surface of the cylindrical shaft, and wherein the inlet comprises a boss with a plurality of guide elements extending radially outward from the boss wherein the guide elements and the cams are configured to contact each other so as to cause the diverter disk to rotate about the axial direction as the diverter disk moves between the first position and the second position.

11. A dishwashing appliance, comprising:

a tub defining a wash chamber;

an inlet defined in the tub and providing air flow into the wash chamber;

a fan configured to selectively urge air through the inlet in a plurality of directions, the plurality of directions including at least a first direction and a second direction different from the first direction; and a diverter disk comprising an aperture, the diverter disk positioned proximate the inlet between the fan and the wash chamber, the diverter disk defining an axial direction, the diverter disk movable along the axial direction between a first position and a second position;

wherein the fan urges the diverter disk to move from the second position to the first position when the fan urges air through the inlet in the first direction, and wherein the fan urges the diverter disk to move from the first position to the second position when the fan urges air through the inlet in the second direction, and wherein, in the first position of the diverter disk, the aperture in the diverter disk is aligned with the inlet and a first air flow path is thereby defined through both the aperture and the inlet by both the aperture and the inlet and, in the second position of the diverter disk, the aperture in the diverter disk is aligned with the inlet and a second air flow path is thereby defined through both the aperture and the inlet by both the aperture and the inlet.

12. The dishwashing appliance of claim 11, wherein the diverter disk is configured to rotate about the axial direction as the diverter disk moves between the first position and the second position.

13. The dishwashing appliance of claim 11, wherein the diverter disk is configured to rotate about the axial direction by about forty-five degrees each time the diverter disk moves from one of the first position and the second position to the other of the second position and the first position.

14. The dishwashing appliance of claim 11, wherein the diverter disk defines a circumferential direction extending around the axial direction, wherein the first position is a first axial position and the second position is a second axial position, wherein the diverter disk is configured to rotate along the circumferential direction from a first circumferential position to a second circumferential position when the diverter disk moves from the first axial position to the second axial position, and to move from the second circumferential position to a third circumferential position when the diverter disk moves from the second axial position to the first axial position, and wherein the diverter disk permits air flow into the wash chamber via the inlet along the first air flow path when the diverter disk is in the first circumferential position and along a third air flow path when the diverter disk is in the third circumferential position.

15. The dishwashing appliance of claim 11, wherein the dishwashing appliance defines a vertical direction, and the axial direction of the diverter disk is oblique to the vertical direction, whereby the diverter disk moves from the first position to the second position due to the air urged through the inlet in the second direction and due to gravity.

16. The dishwashing appliance of claim 11, wherein the diverter disk defines a circumferential direction, and wherein the aperture extends along an arc of approximately ninety degrees along the circumferential direction.

17. The dishwashing appliance of claim 16, wherein the aperture is a first aperture and the diverter disk further comprises a second aperture diametrically opposite the first aperture along a diameter of the diverter disk, the second aperture extending along an equivalent arcuate extent as the first aperture.

18. The dishwashing appliance of claim 11, further comprising a vent positioned at the inlet, and wherein the diverter disk further comprises an external cylindrical surface and a helical groove extending around the external cylindrical surface, and wherein the vent comprises an internal cylindrical surface and a helical thread on the internal cylindrical surface configured to engage the helical groove on the external cylindrical surface of the diverter disk.

19. The dishwashing appliance of claim 11, further comprising a vent positioned at the inlet, the vent comprising a plurality of swirler vanes.

20. The dishwashing appliance of claim 11, wherein the diverter disk comprises a cylindrical shaft defining an interior channel having a plurality of cams disposed on an internal surface of the cylindrical shaft and projecting radially inward from the internal surface of the cylindrical shaft, and wherein the inlet comprises a boss with a plurality of guide elements extending radially outward from the boss wherein the guide elements and the cams are configured to contact each other so as to cause the diverter disk to rotate about the axial direction as the diverter disk moves between the first position and the second position.

* * * * *